US011313131B2

(12) United States Patent
Terenzi

(10) Patent No.: US 11,313,131 B2
(45) Date of Patent: Apr. 26, 2022

(54) OPENABLE SUNSCREEN DEVICE WITH ADJUSTABLE SLATS

(71) Applicant: TENDER S.R.L., Cattolica (IT)

(72) Inventor: Maurizio Terenzi, Cattolica (IT)

(73) Assignee: TENDER S.R.L.

( * ) Notice: Subject to any disclaimer, the term of this patent is extended or adjusted under 35 U.S.C. 154(b) by 0 days.

(21) Appl. No.: 17/284,455

(22) PCT Filed: Oct. 7, 2019

(86) PCT No.: PCT/EP2019/077101

§ 371 (c)(1),
(2) Date: Apr. 10, 2021

(87) PCT Pub. No.: WO2020/074451

PCT Pub. Date: Apr. 16, 2020

(65) Prior Publication Data

US 2021/0355685 A1 Nov. 18, 2021

(30) Foreign Application Priority Data

Oct. 10, 2018 (IT) ..... 102018000009330

(51) Int. Cl.
*E04F 10/10* (2006.01)

(52) U.S. Cl.
CPC ..... *E04F 10/10* (2013.01)

(58) Field of Classification Search
CPC .. E04F 10/10; E04F 10/08; E06B 7/08; E04B 7/163

(Continued)

(56) References Cited

U.S. PATENT DOCUMENTS 2,654,425 A * 10/1953 Hayner ..... E04F 10/10 160/62
4,527,355 A * 7/1985 Numakami ..... E04F 10/10 49/275

(Continued)

FOREIGN PATENT DOCUMENTS

EP 1 555 379 A1 7/2005

OTHER PUBLICATIONS

Bibliographic data, EP1555379A1, including English Abstract, 1 page.

(Continued)

*Primary Examiner* — Beth A Stephan
(74) *Attorney, Agent, or Firm* — Ware, Fressola, Maguire & Barber LLP

(57) ABSTRACT

An openable sunscreen device with adjustable slats (3) moved by at least one distance adjustment member (21) between opened (O) and closed (C) conditions. Each slat (3) has an axle (9) whose ends (11) slide along a first site for sliding (15) of a side guide (17). Each slat (3) has an inclined arm (23) provided with a slider (25). A rotation member (27) provides for rotation of the slat (3) around its axle (9) and includes a longitudinal track element (31) parallel to the site for sliding (15) and a corresponding transversal track element (33). Each transversal track element (33) intersects the longitudinal track element (31) at a respective switch element (35) rotatable between a rotating condition in which it (37) is aligned with the respective transversal track element (33) and a sliding condition in which it (37) is aligned with the longitudinal track element (31).

10 Claims, 26 Drawing Sheets

(58) Field of Classification Search
USPC ..... 160/62
See application file for complete search history.

(56) References Cited

U.S. PATENT DOCUMENTS

| | | | | | |
|---|---|---|---|---|---|
| 5,306,210 | A * | 4/1994 | Smit | F24F 7/02 | 454/250 |
| 8,413,389 | B2 * | 4/2013 | Frigerio | E04F 10/10 | 52/75 |
| 8,756,873 | B1 * | 6/2014 | Hire | E04F 10/10 | 52/72 |
| 9,422,715 | B1 * | 8/2016 | Selzer | E04D 11/00 | |
| 9,650,786 | B2 * | 5/2017 | Weaver | E04B 7/163 | |
| 11,149,438 | B2 * | 10/2021 | Torman | E04F 10/10 | |
| 2006/0040607 | A1 * | 2/2006 | Perez | E06B 7/086 | 454/358 |

OTHER PUBLICATIONS

International Search Report, PCT/EP2019/077101, 3 pages.
Written Opinion of the ISA, PCT/EP2019/077101, 6 pages.

* cited by examiner

OPENABLE SUNSCREEN DEVICE WITH ADJUSTABLE SLATS

BACKGROUND

1. Technical Field

The present invention relates to the technical field concerning building window frames and refers to an openable sunscreen device with adjustable slats suitable for openings, windows, skylights, doors, open walls, and in particular to make roofs even at low slope and that it can be opened and closed and that in the closed condition it allows to adjust the slat inclination.

2. Prior Art

Closing devices for covering are known, for example adopted in winter gardens, greenhouses or constructions in general, which comprise a multitude of slats fit for being arranged on a plane, one adjacent to the other, to close or cover a ceiling or an upper portion of a building and disposed side by side, one facing the other, so forming a sort of compact package to free the roof or ceiling.

A disadvantage of these known closing devices for coverings consists in the fact that the elements for orienting the slats are not always sufficiently precise and reliable.

Another disadvantage of said known devices is that they may have irregularities in the opening and closing motion of the slats.

The prior art document EP 1555379A1 discloses an openable sunscreen device with adjustable slats and assigned for openings and for making coverings, comprises at least a plurality of elongated slat elements.

DISCLOSURE OF THE INVENTION

An object of the present invention is to propose an openable sunscreen device with adjustable slats suitable for openings, windows, skylights, doors, open walls, and in particular suitable for making roofs even with a low slope.

A further object of the present invention is to propose an openable sunscreen device with adjustable slats able to guarantee a perfect and identical orientation of all the slats.

Another object is to propose a device capable of guaranteeing a dual guide for the opening and closing motion of the slats, ensuring their fluidity and reliability.

A further object is to propose a device that acts as a sunscreen able to modulate the intensity of the external light that enters the room or compartment associated with the device.

Another object is to propose a relatively simple and very safe device.

These slat elements are movable at least between the opened and closed conditions and each of them has two minor transversal sides and two longitudinal first and second main sides.

Each slat element has a respective axle parallel to its longitudinal sides; the ends of this axle project from said transversal sides and slides longitudinally along respective first sites for sliding each formed along the longitudinal extension of a side guide element perpendicular to the slat elements.

Each side guide element is assigned to be fixed to a respective side edge of the opening and covering.

Each axle of the slat elements is connected to at least one distance adjustment member between said axles which regulates this distance between a minimum value in the opened condition and a maximum value in the closed condition.

Each slat element carries at least one respective inclined arm element lying on a geometric plane perpendicular to the geometric plane defined by the respective slat element. The free end, or opposite to the respective slat element, of the arm element is provided with a slider element.

Said device further comprises at least one rotation member for the rotation, in the closed condition, of each slat element around the respective axle. Such rotation element comprises a longitudinal track element parallel to said first sites for sliding and, for each slat element, it comprises a corresponding transversal track element. The transversal track elements are mutually parallel and inclined, preferably 90°, with respect to the longitudinal track element and are set at mutual distances equal to the maximum distance value in the closed condition between said axles, and each of them intersects the longitudinal track element at a respective switch element provided with a corresponding swivelling track element rotatable between a rotating condition in which it is aligned with the respective transversal track element and a sliding condition in which it is aligned with the longitudinal track element.

Said device further comprises translation actuator members connected to the rotation member to translate it parallel to the longitudinal track element and swivel actuator members connected to the switch elements to rotate in synchronism the swivelling track elements between the rotating and sliding conditions.

Each slider element of each slat element is assigned to slide in the respective swivelling and transversal track elements for the rotation of the respective slat element in the closed condition and along the longitudinal track element during the translation of the respective slat element between the closed and opened conditions and vice versa.

In an operative condition and closed condition the slider elements of the slat elements slide along the transversal and swivelling track elements due to the rotation member's translation actuated by the translation actuator member and modify the respective slat elements angle rotating them around the respective axles. When the slat elements form a predetermined value of the angle of rotation, for example of about 90°, the slider elements are in the swivelling track elements of the switch elements, aligned with the transversal track elements and the swivel actuator member's actuation aligns such swivelling track elements to the longitudinal track element allowing the sliding along the latter of the slider elements and allowing the distance adjustment member to translate the slat elements into the opened condition or vice versa.

BRIEF DESCRIPTION OF THE DRAWINGS

The characteristics of the invention are highlighted below with particular reference to the accompanying drawings in which.

BEST MODE TO CARRY OUT THE INVENTION

Figure 1:
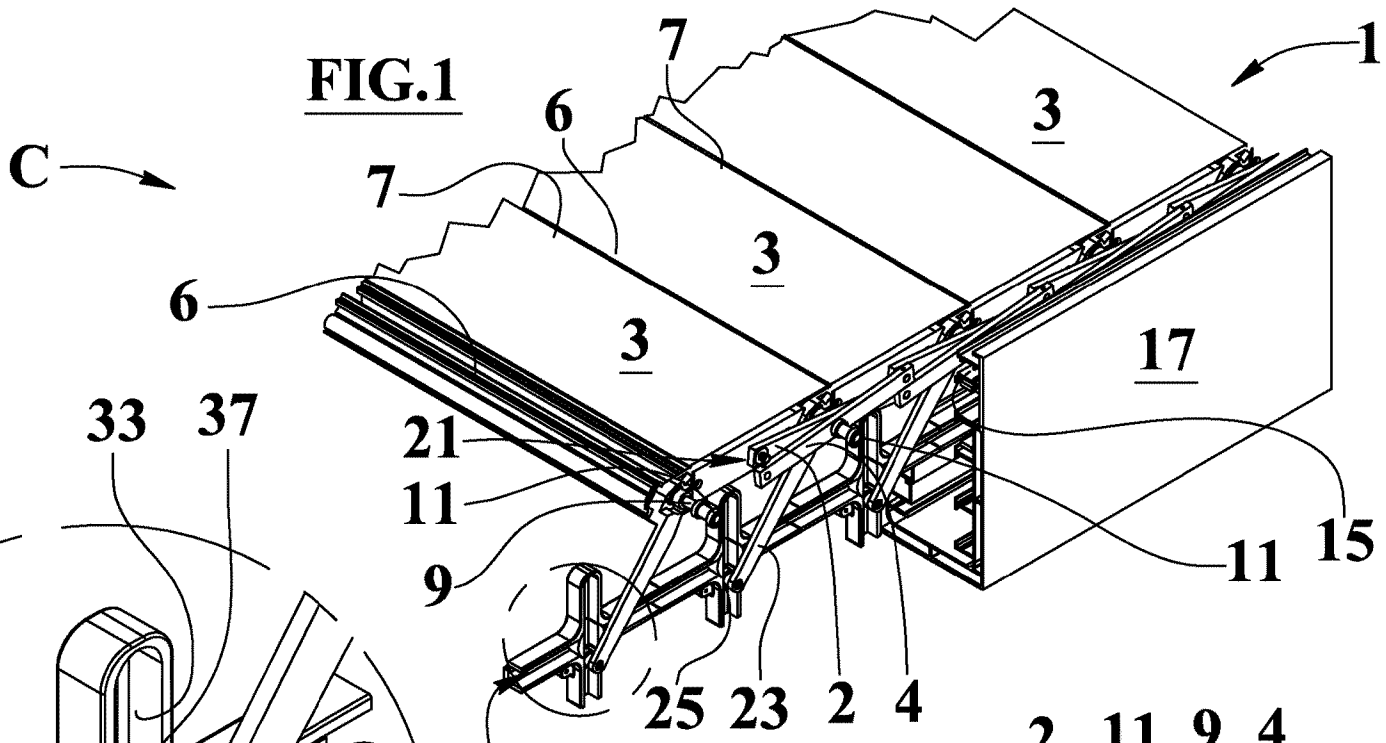
FIGS. 1, 2, 3, 4, and 5 show axonometric, partial views in which some elements have been removed, of the openable sunscreen device with adjustable slats, in fulfilment of an object of the present invention, according to an embodiment thereof, in respective conditions from completely occluded, closed and open.
Figure 10:
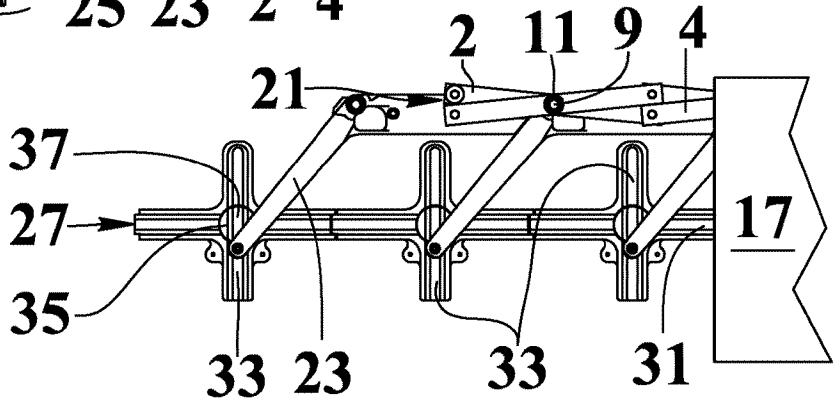
FIGS. 10, 11, 12, 13, and 14 show side views in orthogonal projection of the Figures respectively from 1 to 5.
Figure 6:
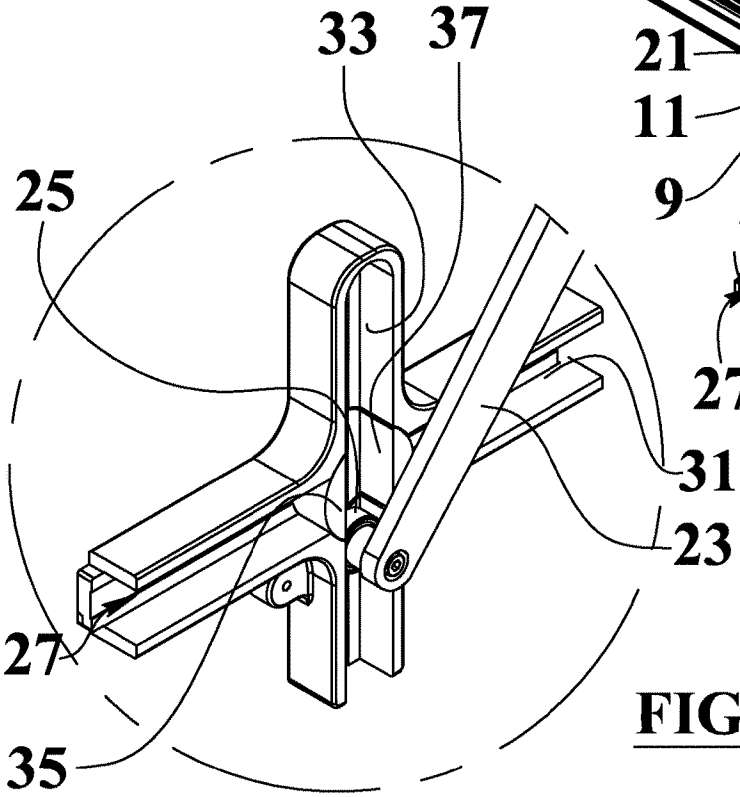
FIGS. 6, 7, 8, and 9 show enlarged details of the Figures, respectively, from 1 to 4.
Figure 2:
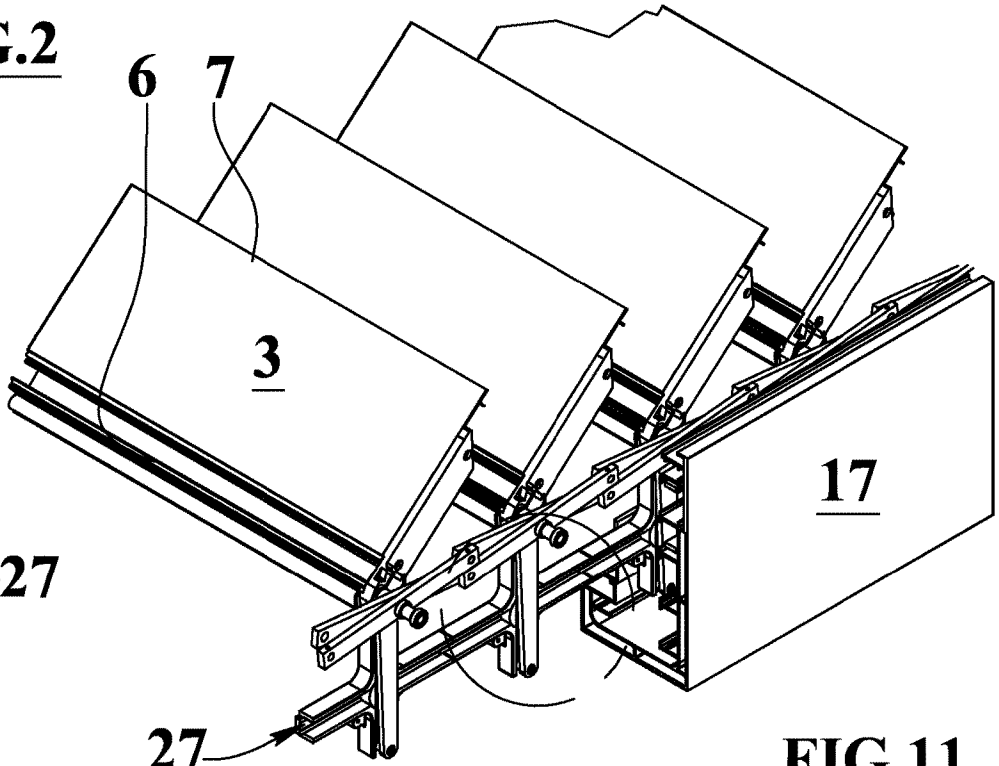
Figure 11:
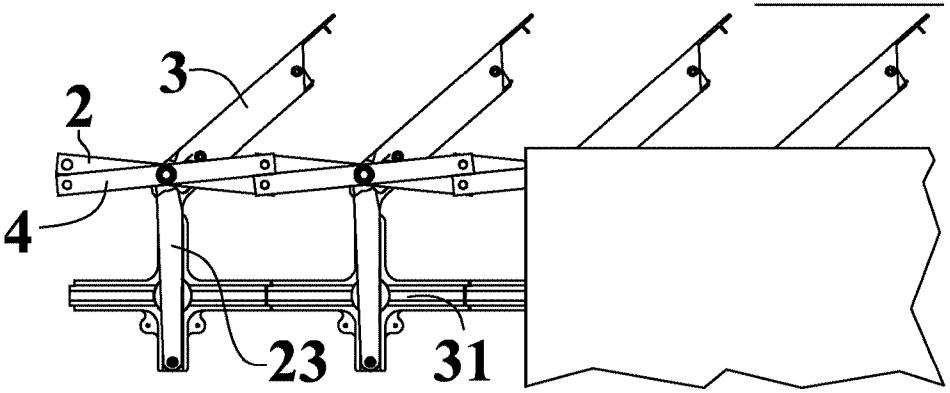
Figure 7:
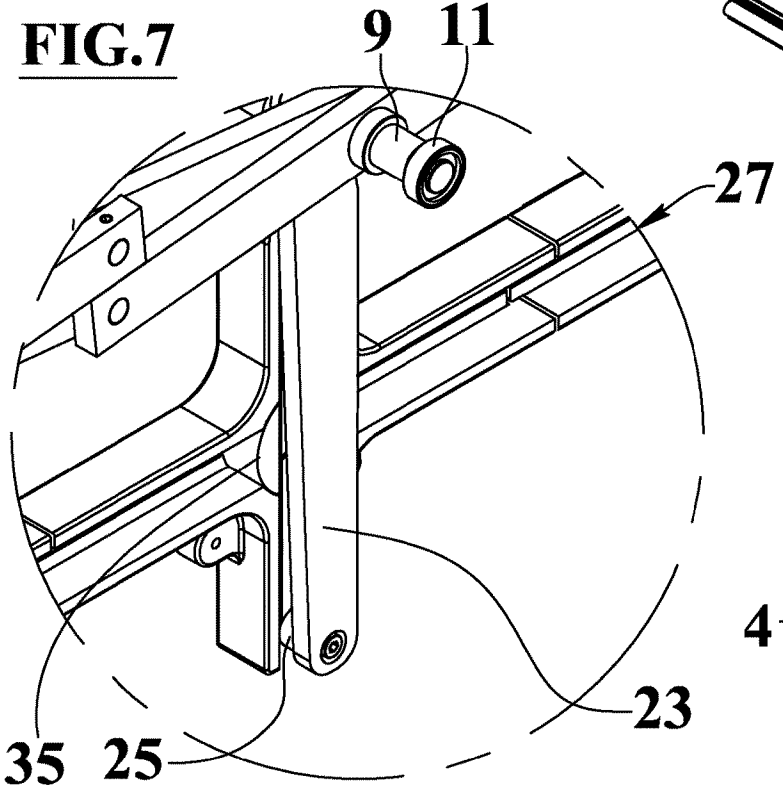

With reference to FIGS. 1-27, numeral 1 indicates an openable sunscreen device with adjustable slats for openings, such as windows, arcades, and other building or architectural elements, and to make coverings, for example of winter gardens, greenhouses and other constructions, to fulfil the object of the present invention according to an embodiment thereof.

In this document, the phrases "opening and closing motion" indicate the slats translation from a condition of maximum separation or maximum mutual distance in which the respective longitudinal axles are at a mutual distance approximately equal to the width of the slats to which the mutual overlap of the slats themselves is subtracted, in which said slats close the passage through the opening or the covering or completely occlude it, towards a minimum mutual distance condition, in which the longitudinal axles of the slats, perpendicularly oriented to the geometric plane of the respective opening or covering, are at minimum distances from each other and less than the width of the slats providing a slats "packing" condition; the terms "opened, closing and occlusion" refer to the respective conditions for opening and closing the passage through the opening or covering and occlusion, also to the light and atmospheric agents, of said covering or openings by the slats; the term "orientation" refers to the angle formed by the slats with respect to the device plane that is with respect to the plane of the covering or opening.

The openable sunscreen device 1 with adjustable slats comprising at least a plurality of elongated slat elements 3, movable in translation between opened O and closed C conditions, in the latter condition C, in rotation to pass from an almost coplanar arrangement in which they completely occlude the opening or covering to an inclined orientation arrangement in which they close the opening or the covering preventing it from crossing but allow the air and/or light passage acting as an adjustable sunscreen.

The device obviously allows the opposite rotation of the slat elements.

Each of these slat elements, for example of the aluminium profiled type, in other metals or alloys, or in plastic or synthetic materials also of composite type, has an almost rectangular shape in plan.

The slat elements can be obtained from an extruded section bar, of aluminium or other material, cut to size according to the opening or the covering. Each slat element has two transversal minor sides and two first 6 and second 7 longitudinal main sides.

Figure 3:
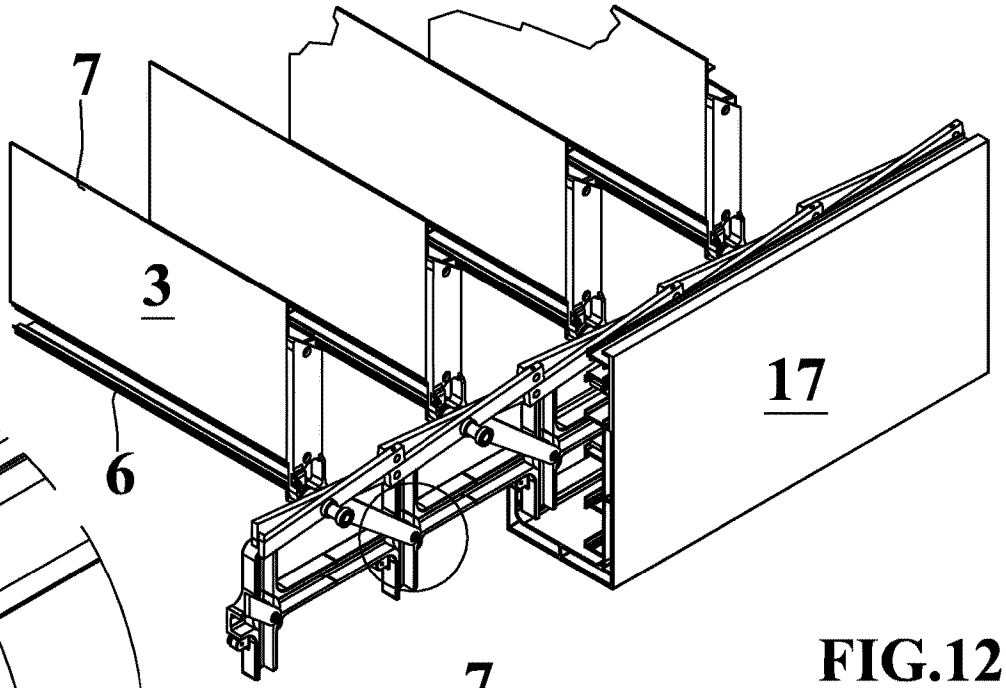
Figure 12:
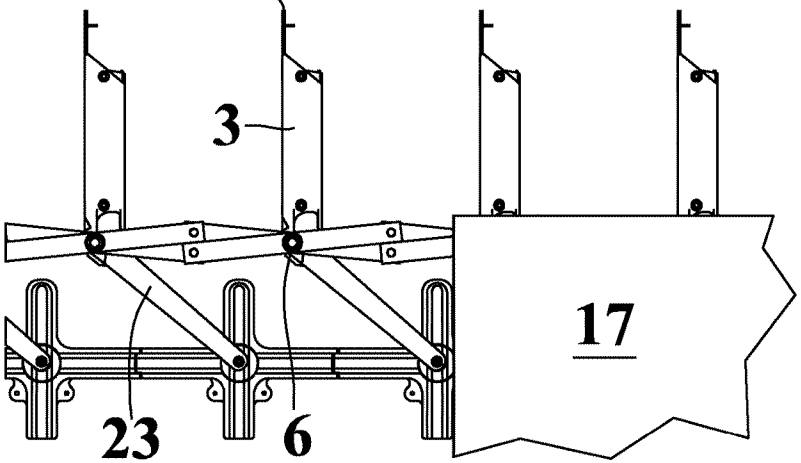
Figure 8:
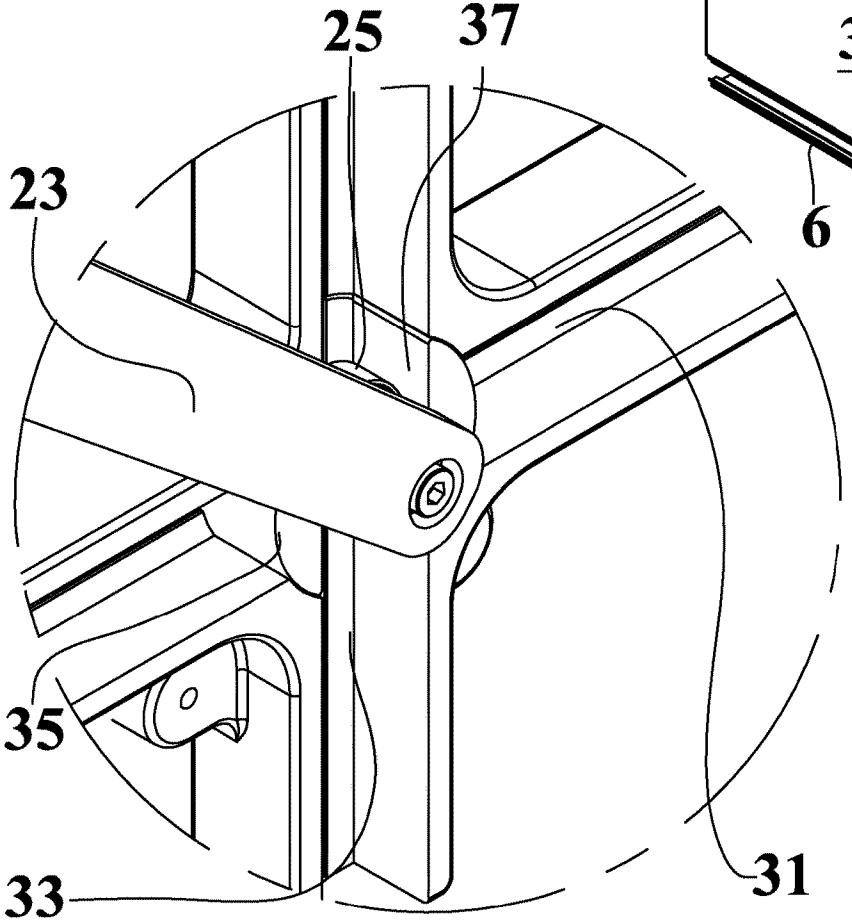
Figure 4:
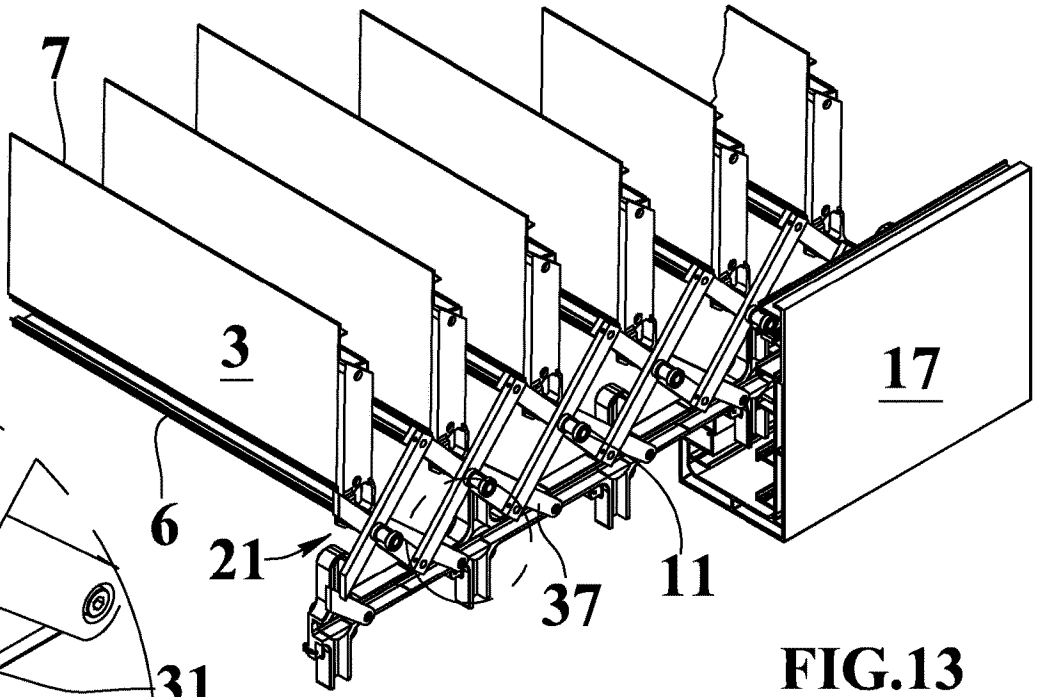
Figure 13:
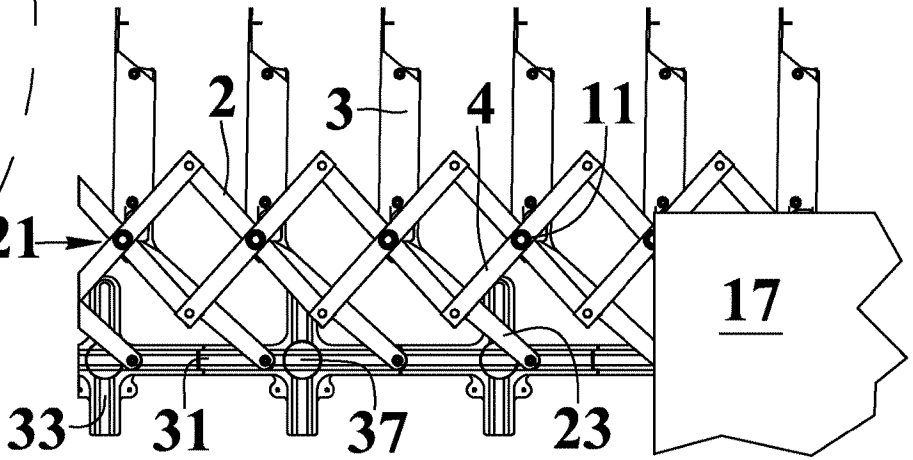
Figure 9:
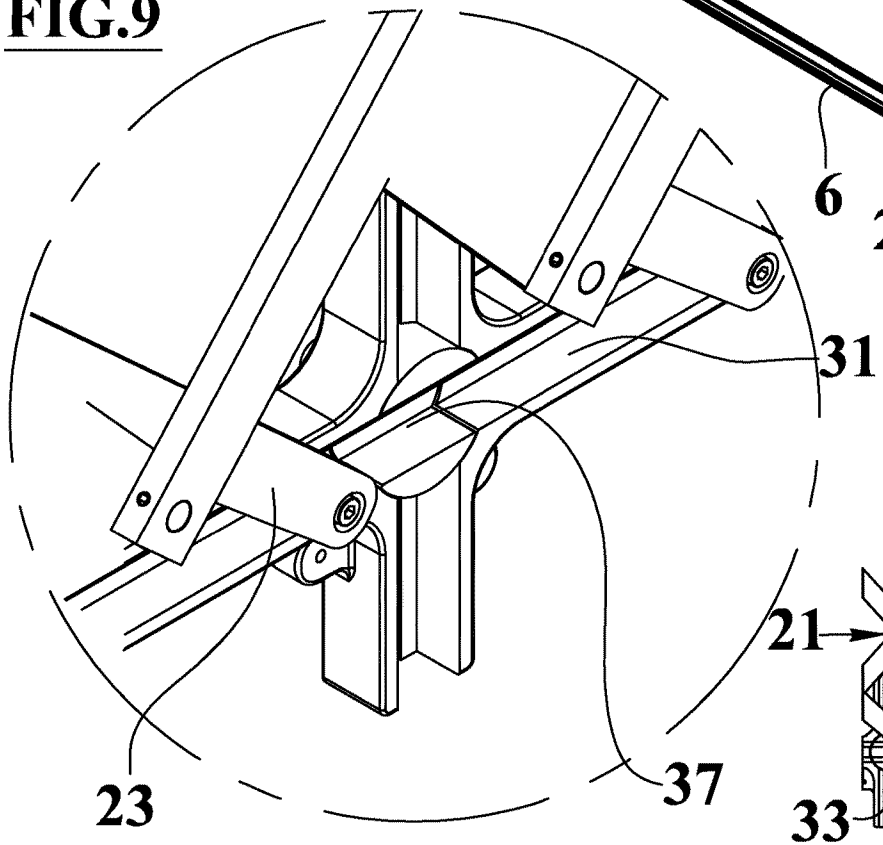
Figure 5:
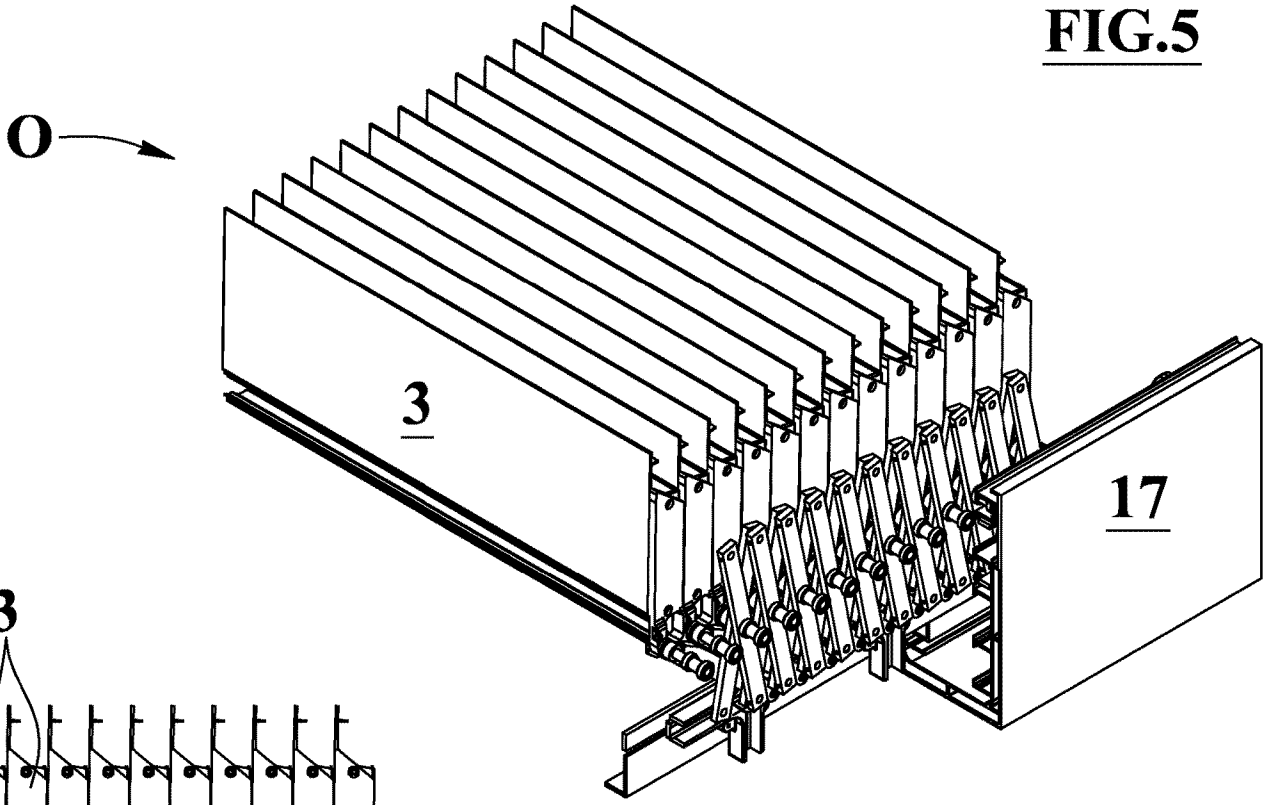
Figure 14:
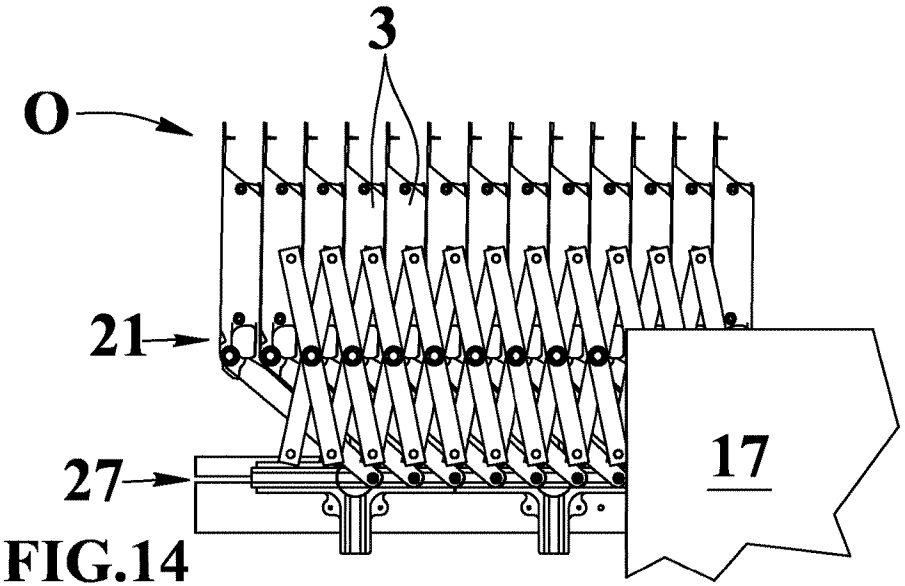
Figure 28:
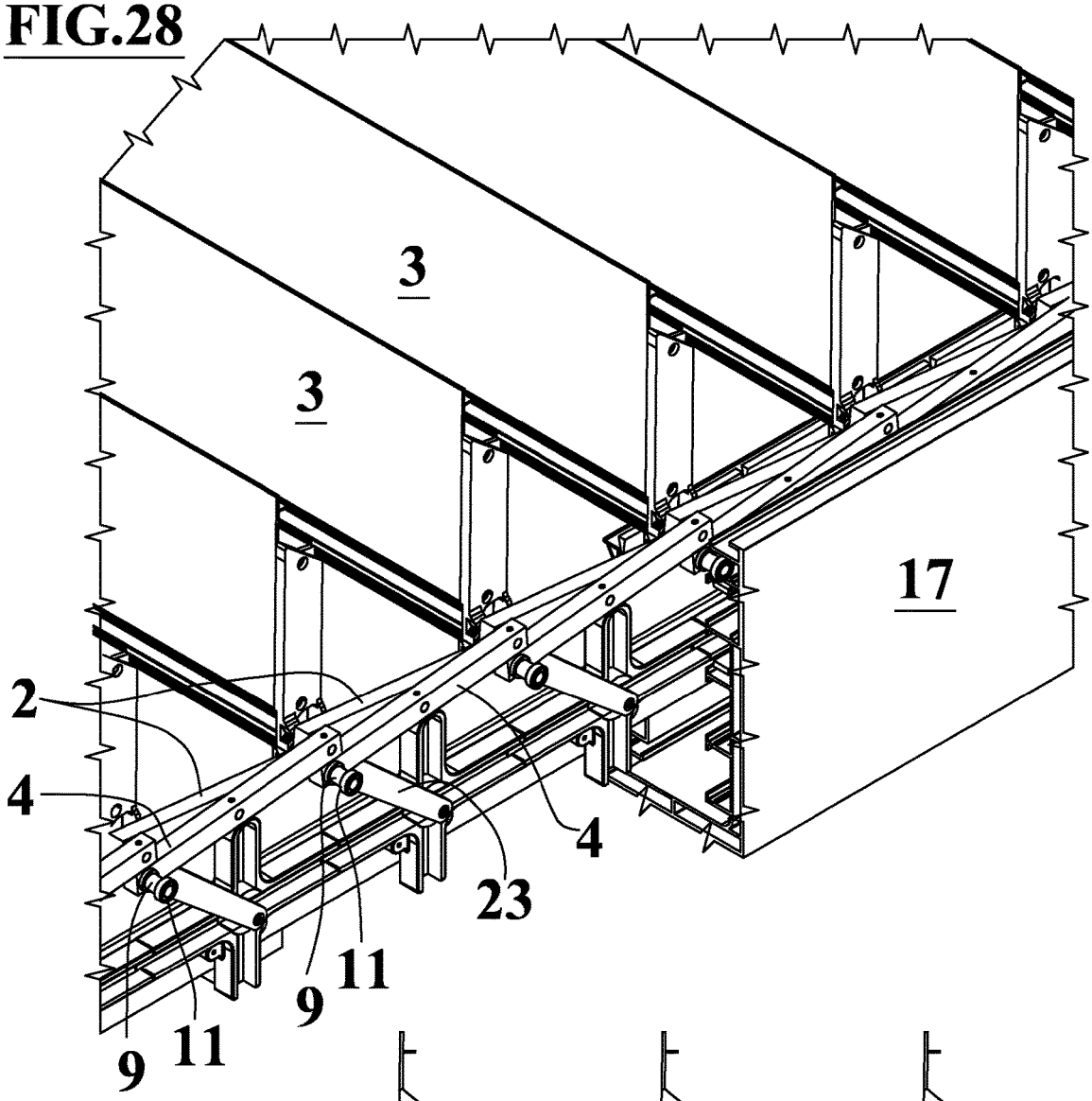
FIGS. 28 and 29 show partial and respectively axonometric and in orthogonal side projection views of a variant of the device of FIG. 1 in a closed condition but not of complete occlusion.
Figure 29:
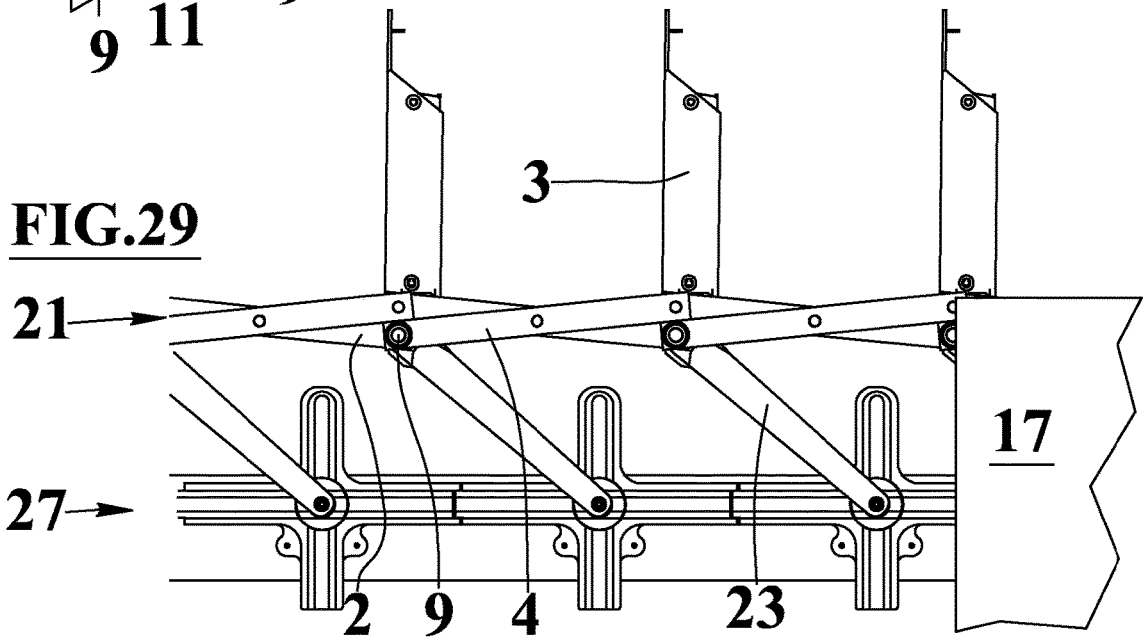
Figure 30:
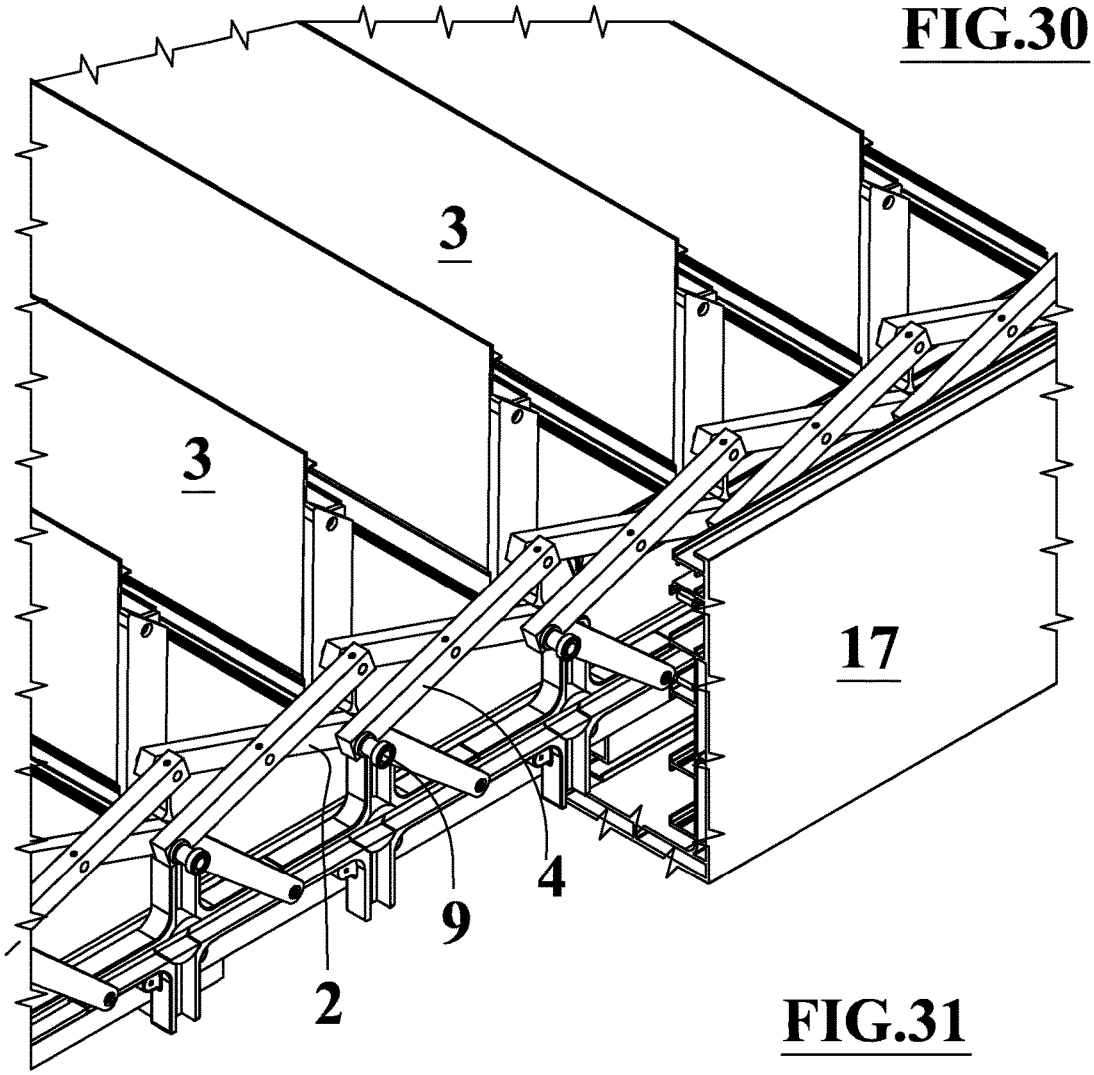
FIGS. 30 and 31 show the elements of FIGS. 28 and 29 in a condition of partial opening.
Figure 31:
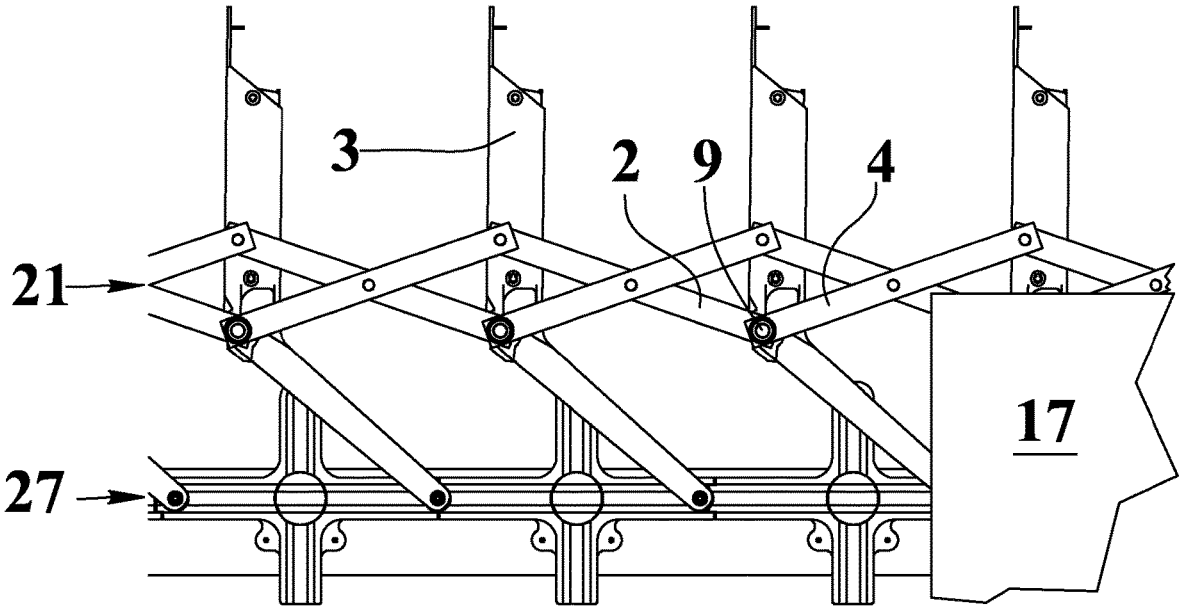
Figure 33:
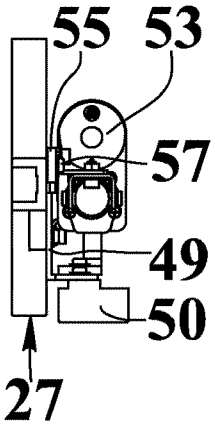
FIGS. 32, 33, and 34 illustrate side and front orthogonal projection views and in axonometric of a set of elements of FIG. 28.
Figure 32:
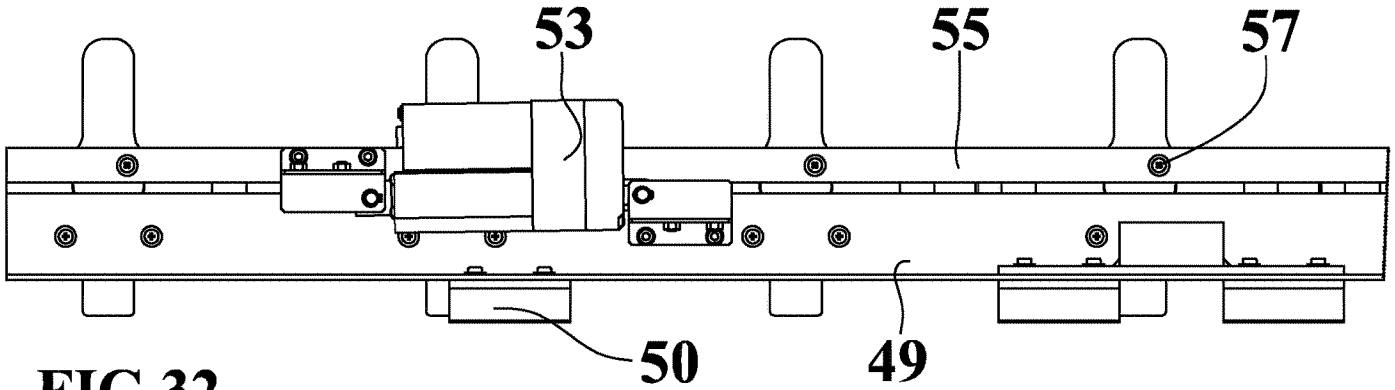
Figure 34:
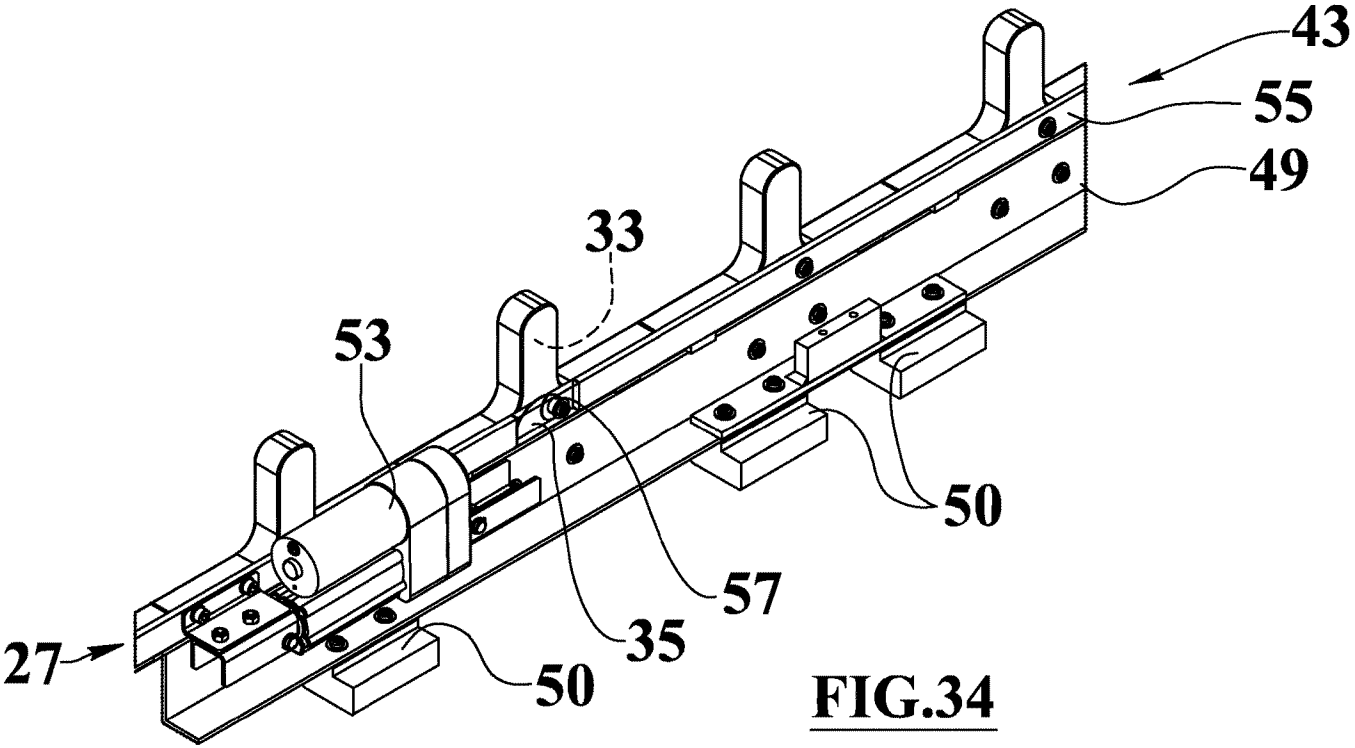

With reference to a device 1 for forming a horizontal or nearly horizontal covering and to the perpendicularly oriented slat elements, i.e. arranged on vertical or nearly vertical planes, the first longitudinal main side 6 of each slat element is smaller than the corresponding second side 7 as illustrated in FIGS. 3, 12 and 28.

Each slat element 3 is provided with a respective axle 9, for example of very elongated cylindrical shape and made of stainless steel or other strong material, arranged longitudinally to the slat element, that is parallel to its longitudinal sides 6, 7.

As illustrated in the Figures, the axle 9 is fixed to or inserted in the slat element corresponding first longitudinal main side 6; alternatively, the axle 9 can be arranged at the centreline of the respective slat element 3 or at one of the longitudinal sides 6, 7 of the slat element 3.

The right and left ends 11 of the axle 9 of a slat element 3 protrude from the respective transversal sides and slide longitudinally along respective side first sites for sliding 15 each formed along the longitudinal extension of a corresponding longitudinal side guide element 17, respectively right side and left side, of a device 1 rectangular frame 48.

Figure 20:
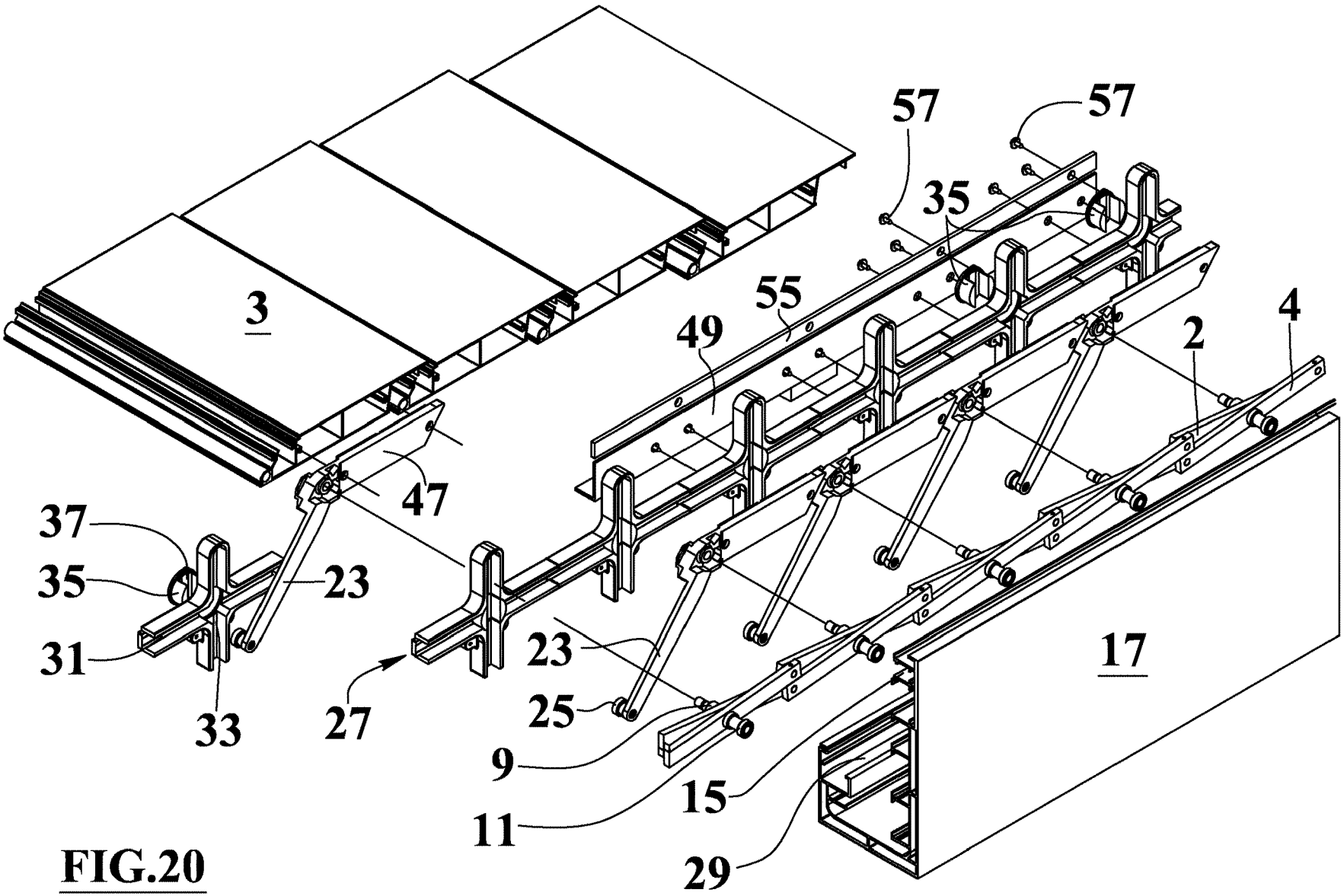
FIG. 20 shows an axonometric and exploded view of FIG. 1.
Figure 21:
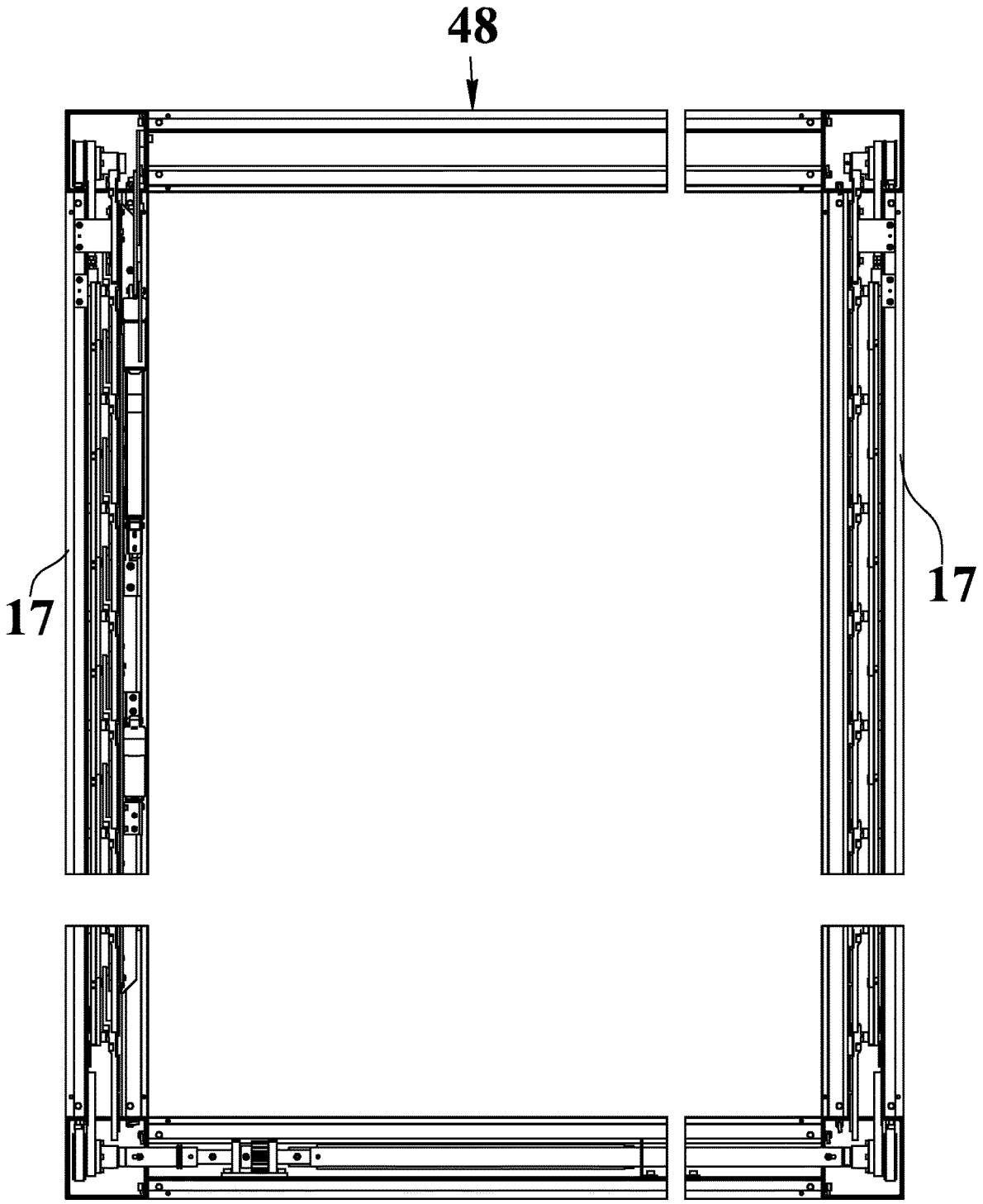
FIG. 21 shows a view from above of a frame of the device of FIG. 1 in which some parts have been removed to better highlight others.
Figure 22:
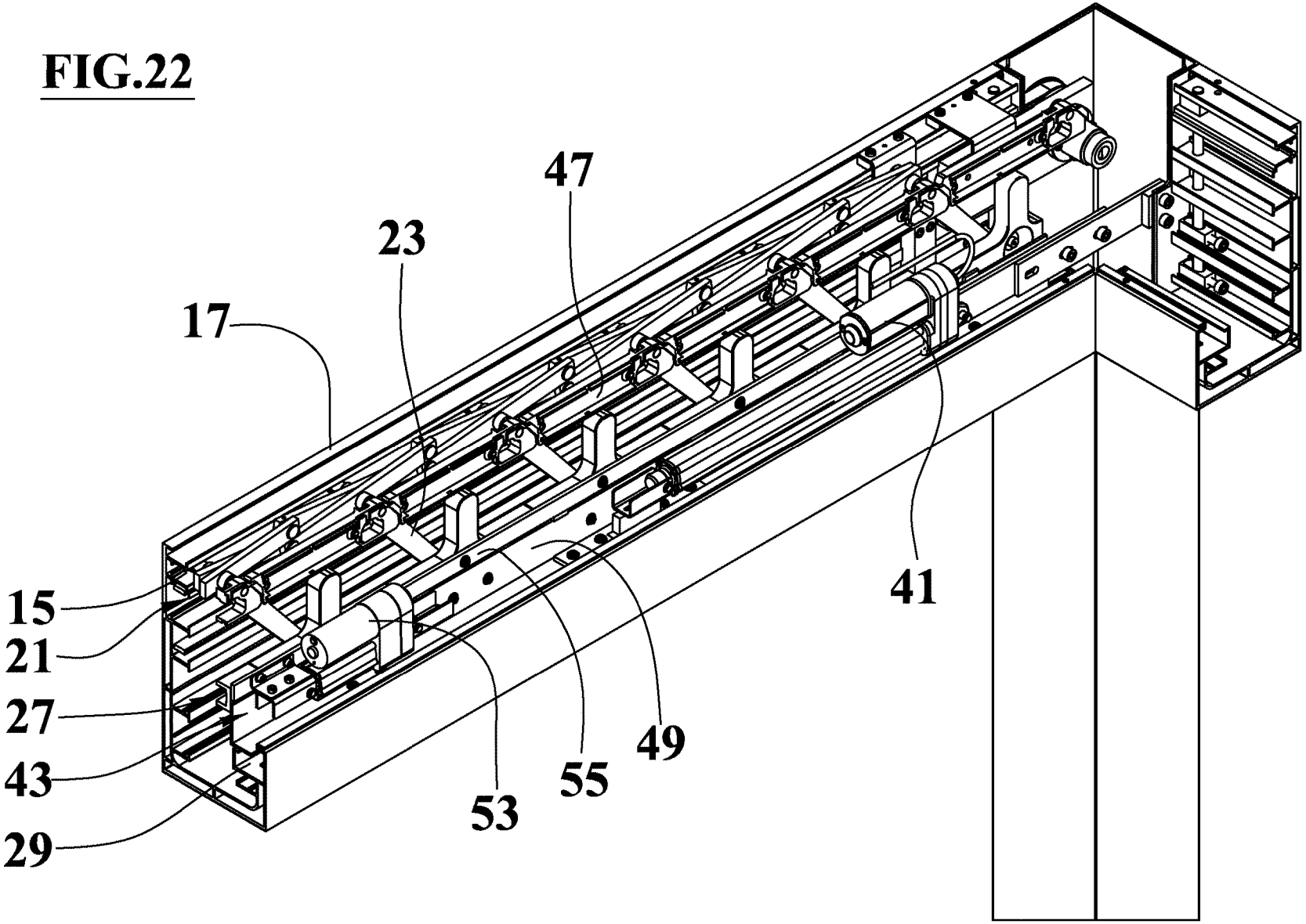
FIG. 22 shows an enlarged and axonometric view of a FIG. 21 detail.

This axle 9 can be in a single body and it can expands without interruption between its protruding ends 11 or it can be constituted by two separate and aligned segments fixed to the respective slat element side ends, as shown for example in FIG. 20.

Each right or left longitudinal side guide element 17 consists of an extruded section bar, for example made of aluminium or its alloys or of another metallic or non-metallic material of suitable weatherproof and mechanical characteristics.

Said frame 48 can comprise four section bars of the same section and characteristics, i.e. the frame 48 can be constituted by the two side guide elements 17 and by two transversal section bars of the same type as those from which the side guide elements 17 are formed, the four section bars are mutually joined by angle sections or angle posts to which the ends of these four section bars are fixed.

The two longitudinal side guide elements 17 right and left are perpendicular to the slat elements 3 and the device 1 frame 48 is assigned to be fixed to the edges of the opening or of the covering.

The side guide elements 17 ends are mutually connected by transversal section bars of the frame 48 which can be obtained from the same extrusion from which the side guide elements 17 are obtained.

The side guide element 17 and the transverse sections are cut to the extent of the opening or of the covering and the transverse sections are of approximately equal length or preferably longer than the length of the slat elements.

The right and left ends 11 of each axle 9 can be provided with wheels, bearings or low friction pads for rolling or sliding smoothly and without jamming along first sites for sliding 15 of the right or left side guide element 17.

At least one of the ends of each axle 9 of the slat elements 3 is connected to a corresponding distance adjustment member 21 between said axles 9 among a minimum distance value in the opened condition O and a maximum distance value in the closed condition C.

Preferably and as illustrated in the Figures, the device comprises two distance adjustment members 21, one connected to the right ends and the other to the left ends of the axes 9.

The two right and left distance adjustment members 21 can be accommodated, even partially, in the section bars of the right or left side guide element 17.

Each slat element 3 carries at least one respective arm element 23, central, right or left, inclined and lying on a geometric plane perpendicular to the geometric plane defined by the respective slat element 3.

Each arm element 23 is provided at its free end with a slider element 25 consisting, for example, in a slider or preferably in a wheel or bearing.

The device 1 comprises at least one rotation member 27, central, right or left, such as the arm element 23 to which it is connected; this rotation member 27 is assigned to the rotation, in the closed condition C, of each slat element 3, around its own axle 9.

Preferably each slat element carries two arm elements 23, one fixed to the right transversal minor side of the slat element and the other fixed, with a concordant inclination, to the left transversal minor side of the same slat element and the device is provided with two side rotation members 27, one for the right arm elements 23 and the other for the left ones.

The two right and left side rotation members 27 are housed, at least partially in the section bars of the right or left side guide elements 17 and can translate axially or parallel to their own longitudinal extension and of the respective side guide elements along respective sides' second sites for sliding 29 formed in the section bars of the right or left side guide elements 17 themselves.

Each rotation member 27 comprises a longitudinal track element 31 parallel to said first lateral site 15 and second lateral site 29 for sliding and, for each slat element 3, a corresponding transversal track element 33.

These transversal track elements 33 are mutually parallel and inclined, preferably of 90°, relative to the longitudinal track element 31.

The transversal track element 33 of each right or left rotation member 27 are set at mutual distances equal to the maximum distance value in the closed condition C between said axles 9 where this maximum distance value is almost equal to that between said slider elements 25 in the same condition.

Each of such transversal track elements 33 intersects the longitudinal track element 31 at a respective switch element 35 provided with a corresponding swivelling track element 37 rotatable between a rotating condition of the slats elements in which the swivelling track element 37 is aligned with the respective transversal track element 33 and a sliding condition of the slat elements in which the swivelling track element 37 is aligned with the longitudinal track element 31.

These longitudinal track elements 31, transversal 33 and swivelling 37 are provided with respective channels, for example with a "C" section for the sliding or rolling of the slider elements 25 of the respective arm elements 23.

When the slider elements 25 are in the respective swivelling track elements 37, for example and as occurs in the illustrated embodiment, in the closed condition C and when the slat elements form a predetermined value of the rotation angle for example, and as illustrated, when the slat elements 3 have an orthogonal orientation, the rotation of these swivelling track elements 37 allows the slider elements 25 to be placed in the sliding condition along the transversal track element 33 or the swivelling track element 37.

Said device 1 further comprises translation actuator members 41 connected to the right and left rotation members 27 for translating them parallel to the respective longitudinal track elements 31 along said second sites for sliding 29.

The device 1 also comprises swivel actuator members 43 connected to the switch elements 35 of right and left rotation member 27 for synchronically rotating the swivelling track element 37 between the rotating and sliding conditions.

Each slider element 25 of each slat element 3 is assigned to slide in the corresponding swivelling 37 and transversal 33 track elements aligned for the rotation of the respective slat element in the closed condition C; in other words, when the slider elements 25 are housed in the respective swivelling track elements 37 aligned with the corresponding transversal track elements 33, the actuation of the translation actuator members 41 causes the translation of the rotation members 27, the sliding of the slider elements 25 along the respective swivelling 37 and transversal 33 track elements aligned and the simultaneous rotations of the arm elements 23 and the slat elements 3 so modifying the angle of the slat elements 3 by rotating them around the respective axles 9.

In said closed condition C and with an orthogonal orientation of the slat elements 3, that is when the latter form said predetermined value of the rotation angle, the slider elements are in the respective swivelling track elements 37 and the actuation of the swivel actuator members 43 causes the rotation of the switch elements 35 and the alignment of the swivelling track elements 37 with the respective right or left longitudinal track element 31 allowing the right and left distance adjustment member 21 to translate the slat elements 3 towards the opened condition O.

Each distance adjustment member 21 comprises a pantograph provided with a pair of arms 2, 4, mutually pivoted and "X" crossed that is mutually articulated in the respective central portions, for each slat element 3.

The axle 9 of each slat element is rotatably connected to at least one of these arms 2, 4 of said pair, in particular in said embodiment of FIGS. 1-27, the slat elements axles 9 constitute the mutual central articulation pins of the arms 2, 4 of each pair of crossed arms, that is, the axles 9 act as a crossing pivot of the two arms 2, 4.

In the variant of FIGS. 28-40 each axle 9 acts as an articulation pivot for the lower ends of two arms 2, 4 of two adjacent pairs of arms, as further alternatives, the invention provides that each axle 9 acts as an articulation pivot for the upper ends of two arms 2, 4 of two adjacent pairs of arms or the axes being rotatably supported in respective seats formed in one of the arms 2, 4 of each pair of crossed arms.

Figure 15:
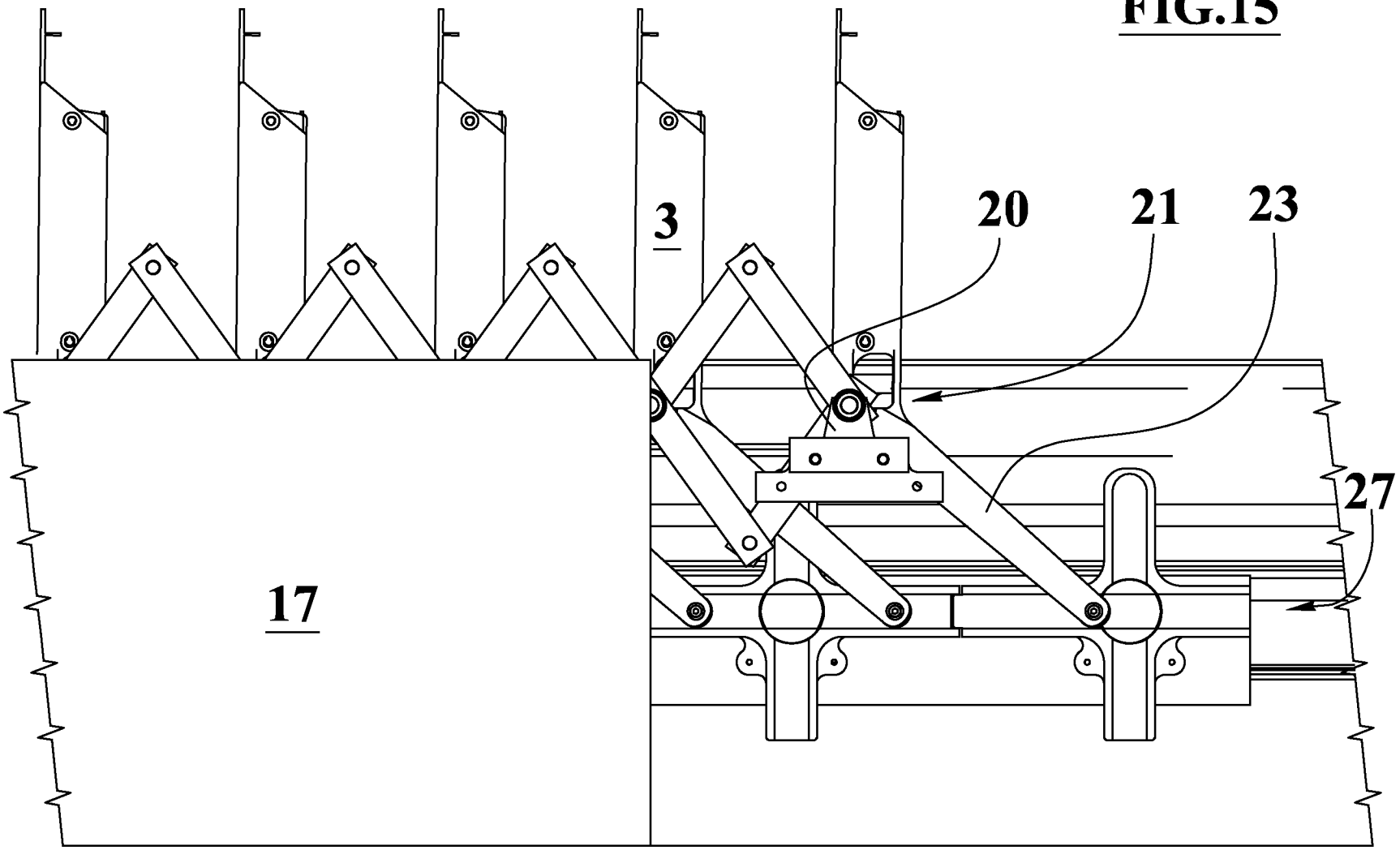
FIG. 15 shows an enlarged side view, in which some parts have been removed, of an end portion of some elements of FIG. 13.
Figure 16:
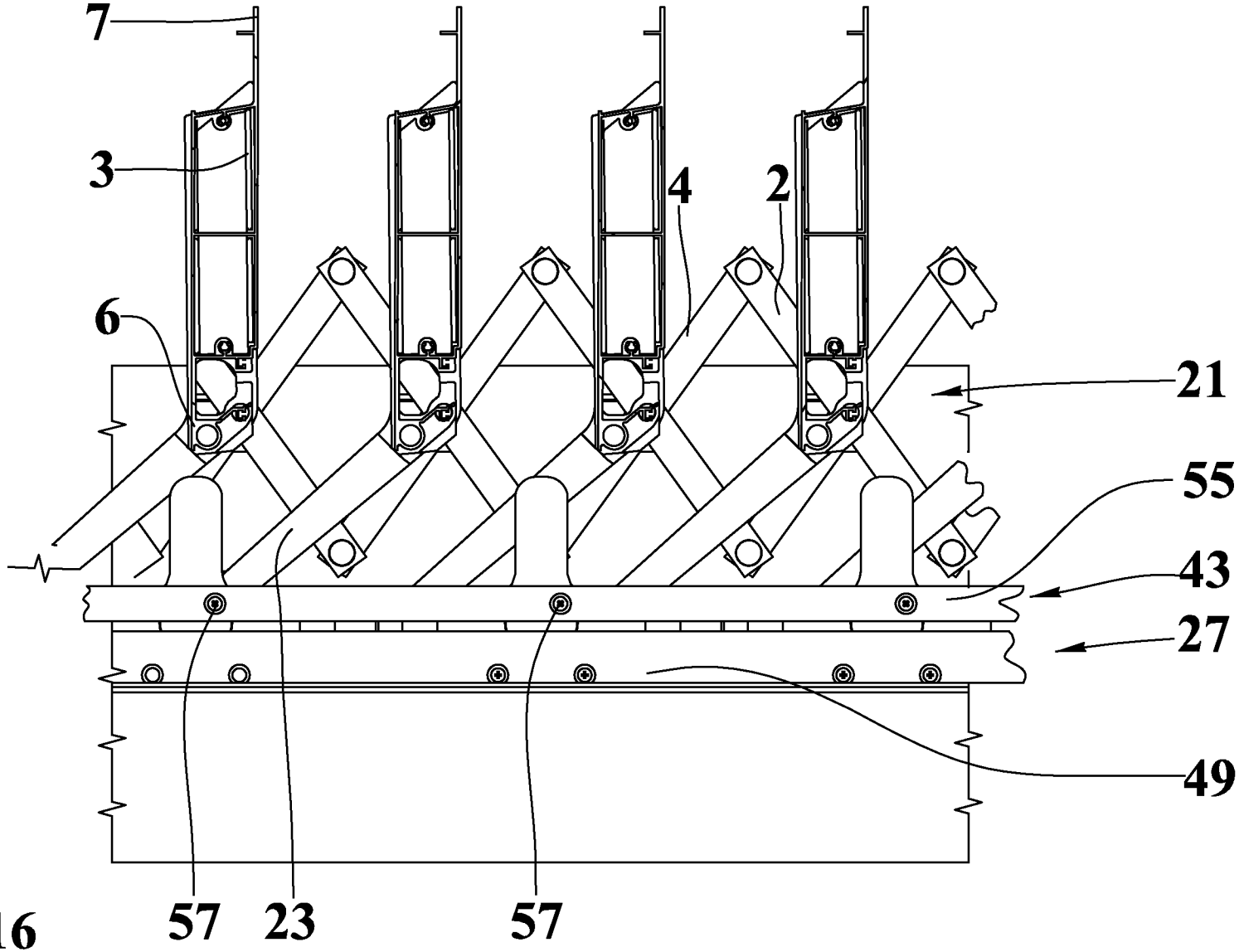
FIG. 16 shows an enlarged view from the opposite side of FIG. 13, and in which some parts have been removed.
Figure 17:
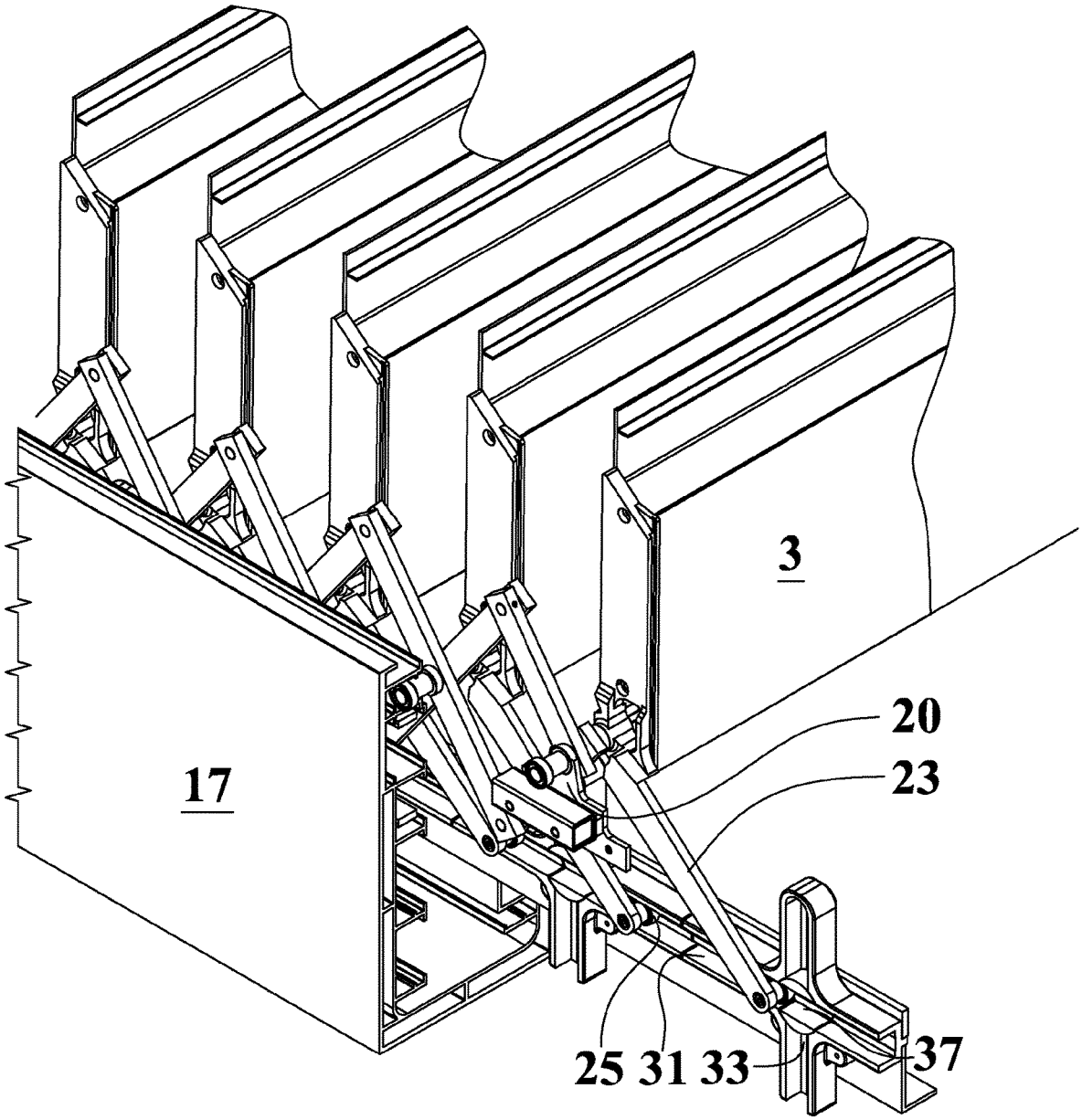
FIG. 17 shows an axonometric view of FIG. 15.
Figure 18:
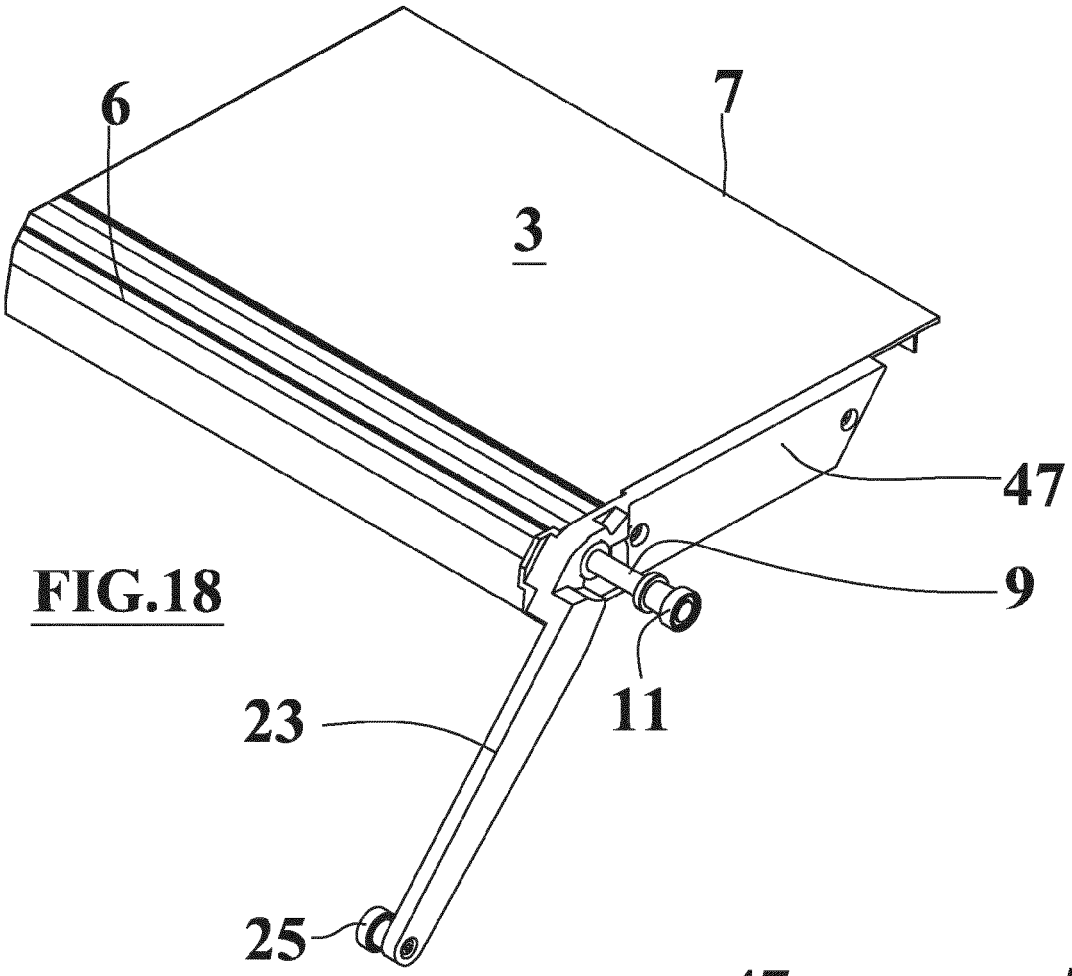
FIGS. 18 and 19 show enlarged respectively axonometric and side views of an assembly of some elements of FIG. 1.
Figure 19:
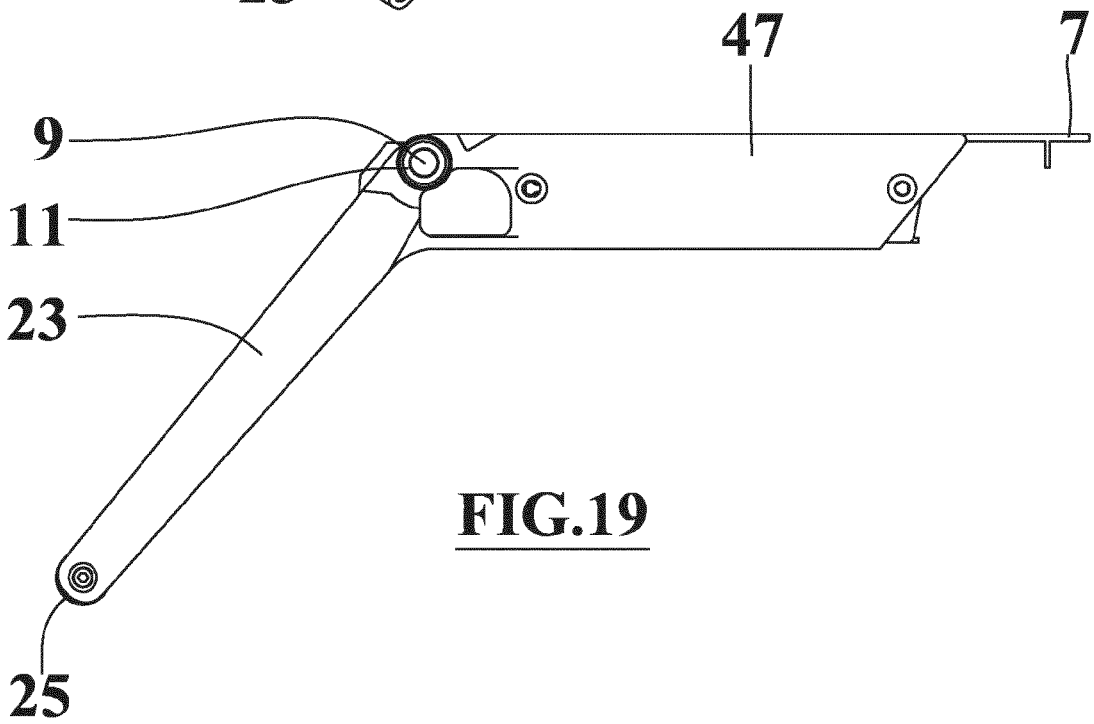
Figure 27:
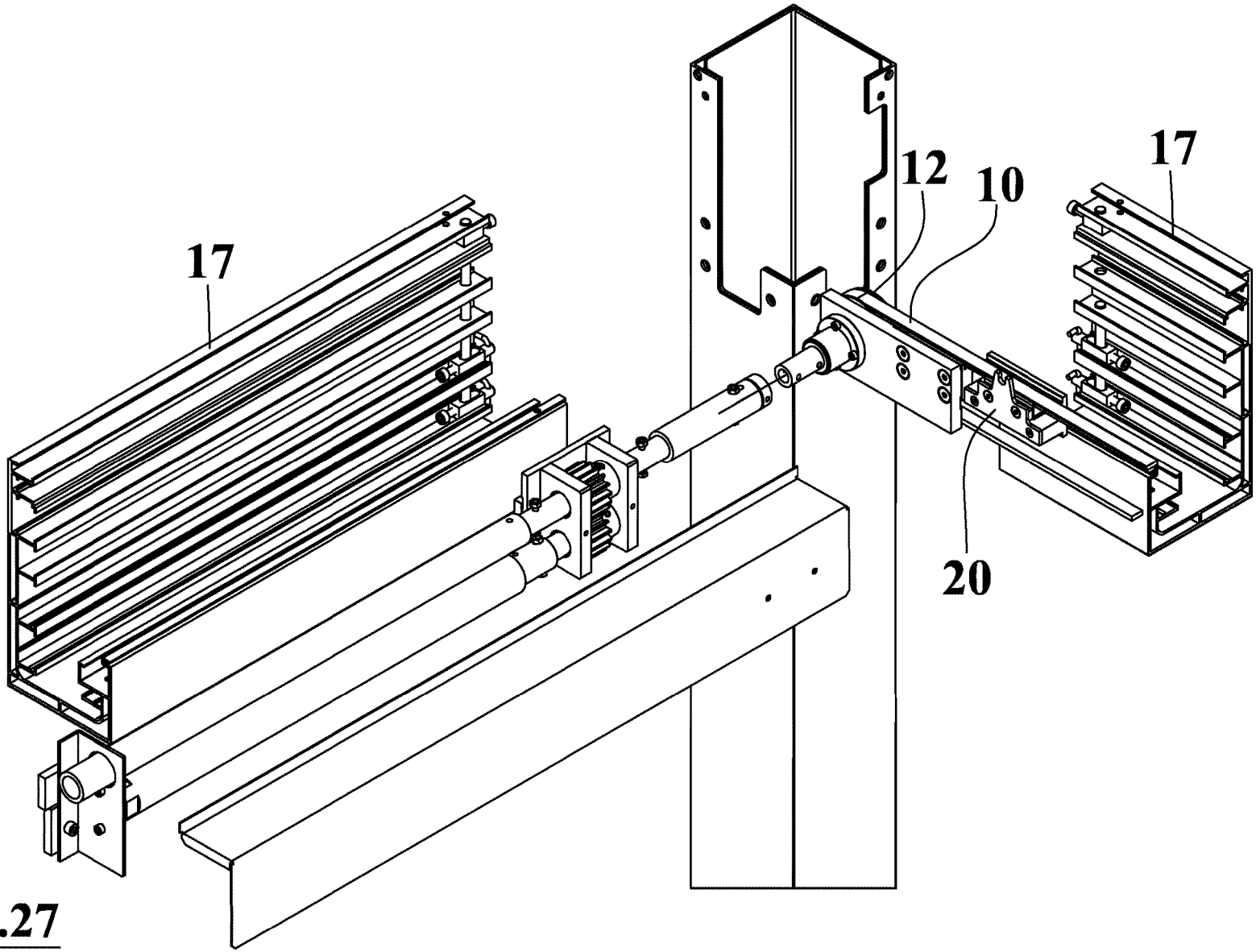
FIG. 27 illustrates an exploded view of FIG. 26.
Figure 35:
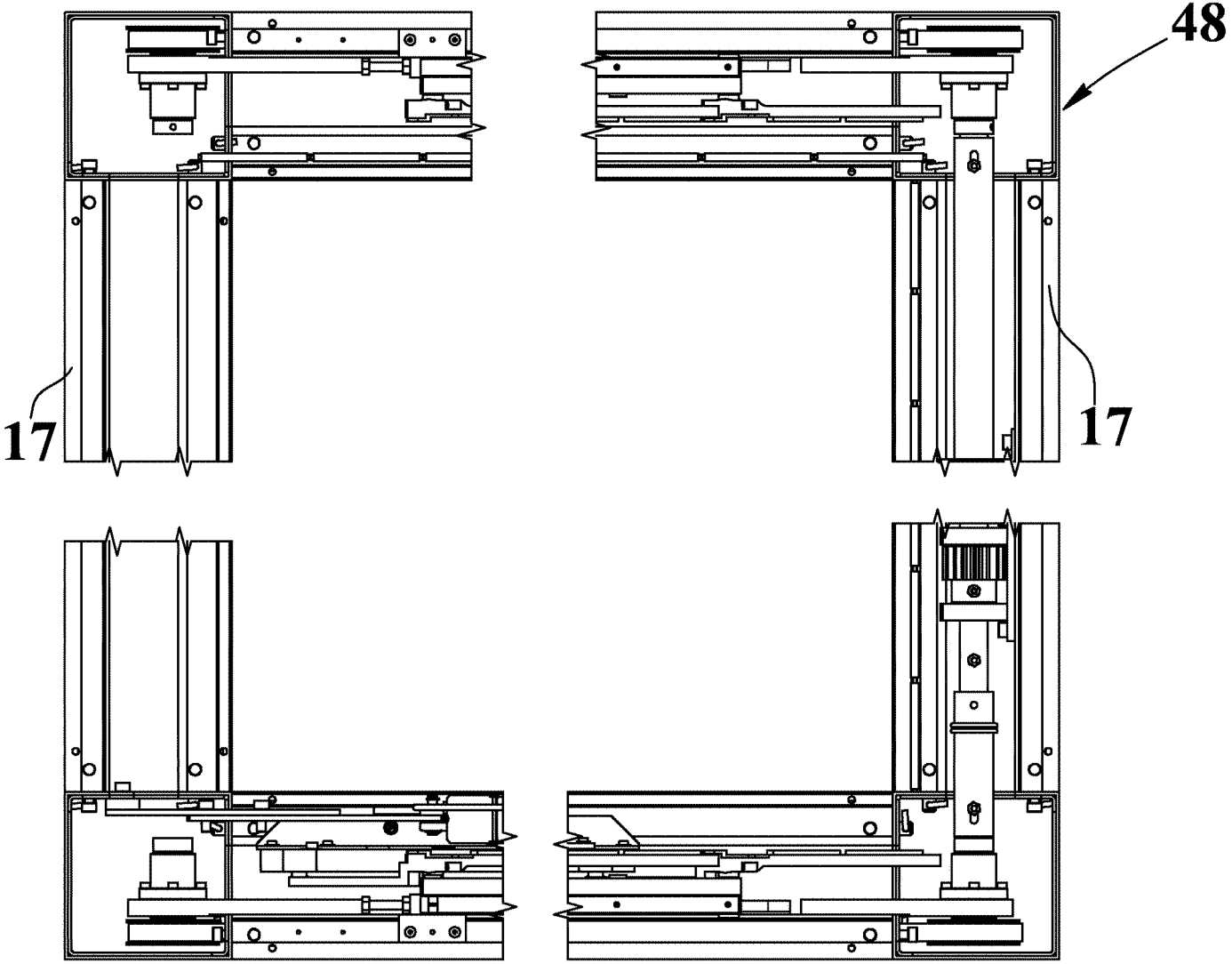
FIG. 35 shows a view from above of a frame of the device of FIG. 28 in which some parts have been removed to better highlight others.
Figure 36:
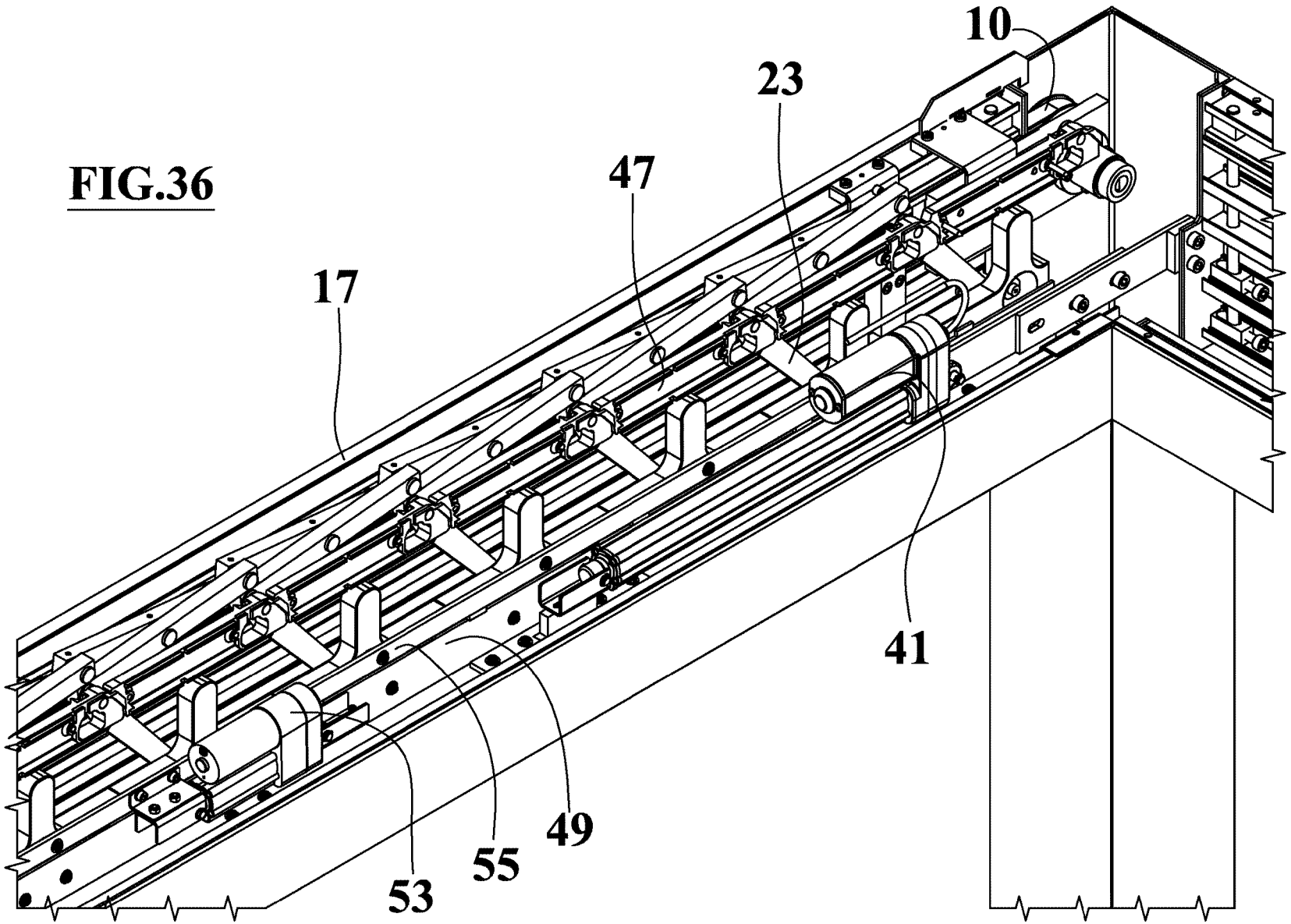
FIGS. 36, 37, 38, and 39 show enlarged views of respective details of FIG. 35.
Figure 37:
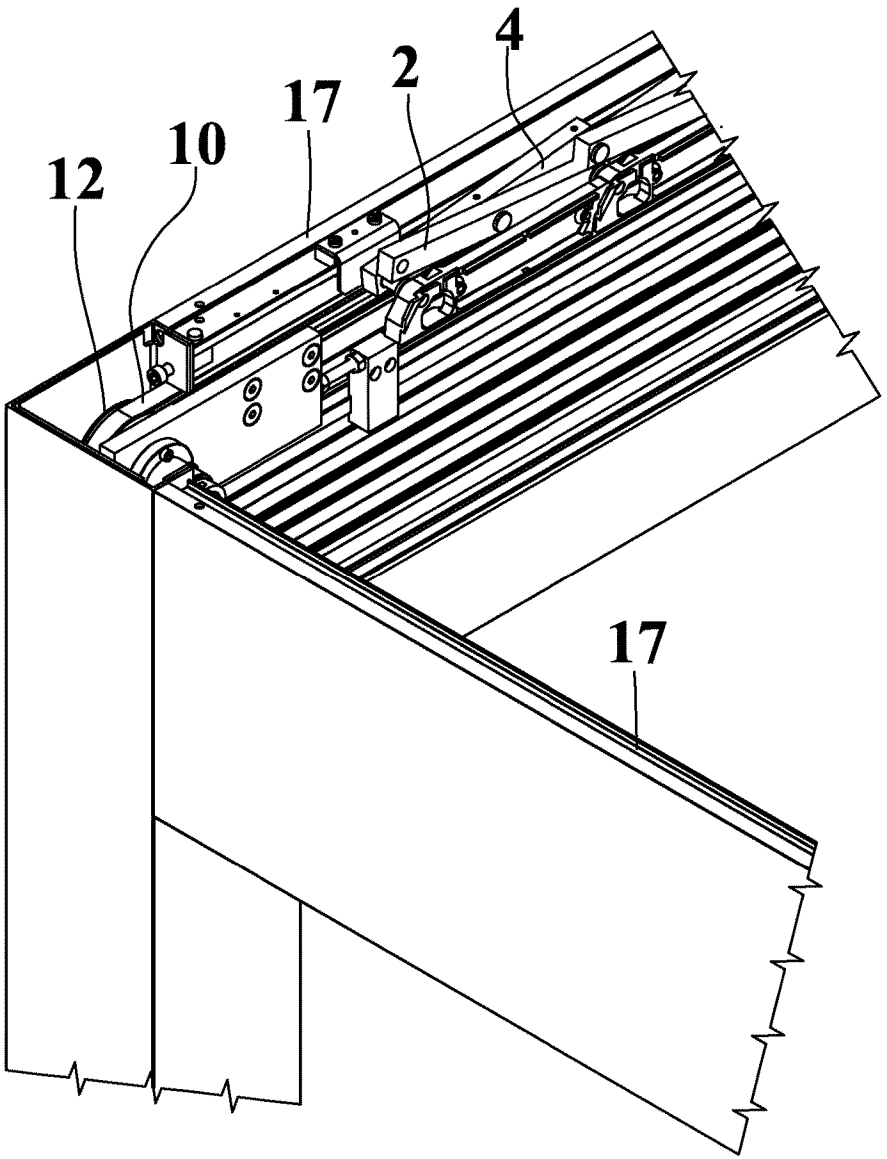
Figure 38:
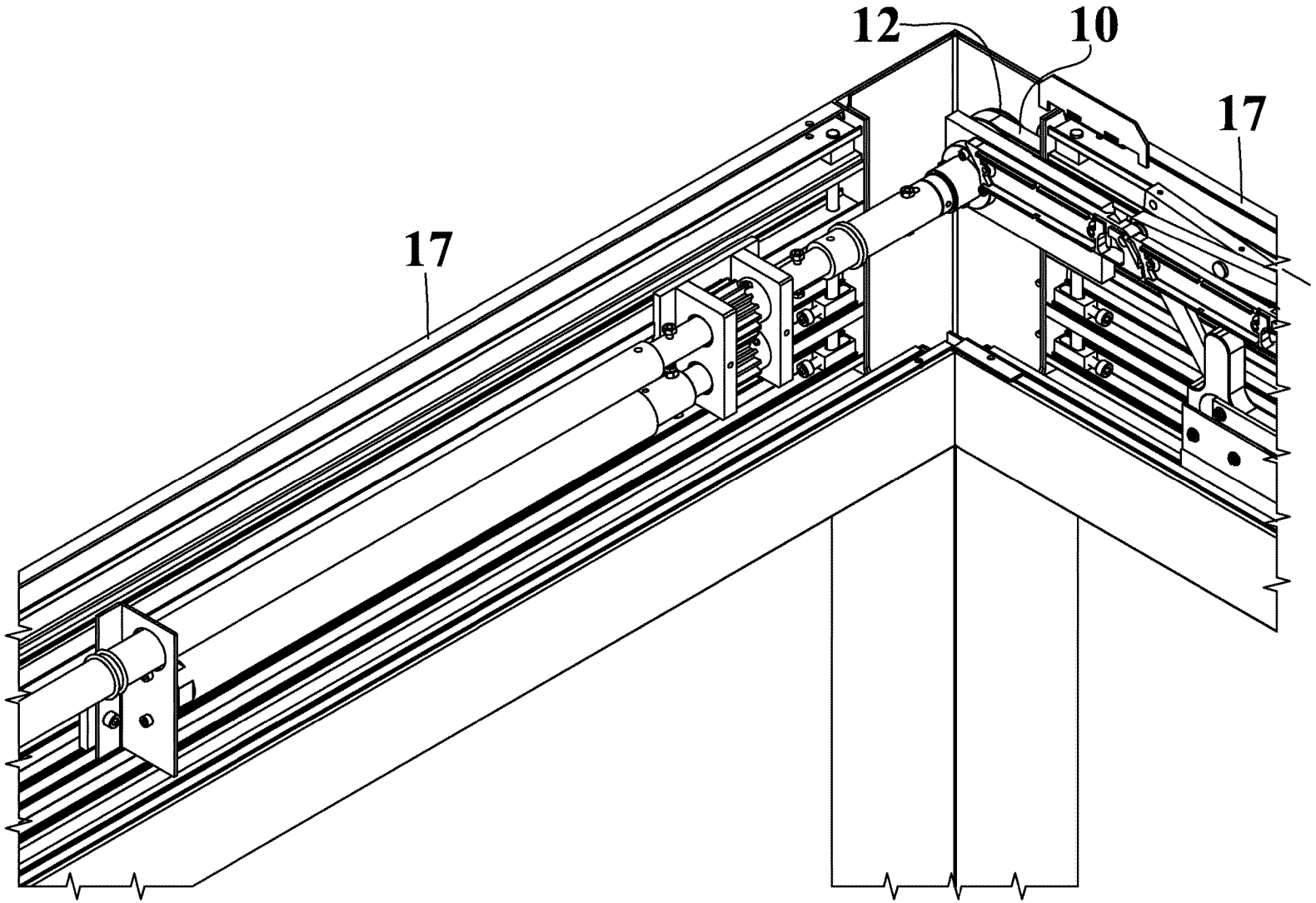
Figure 39:
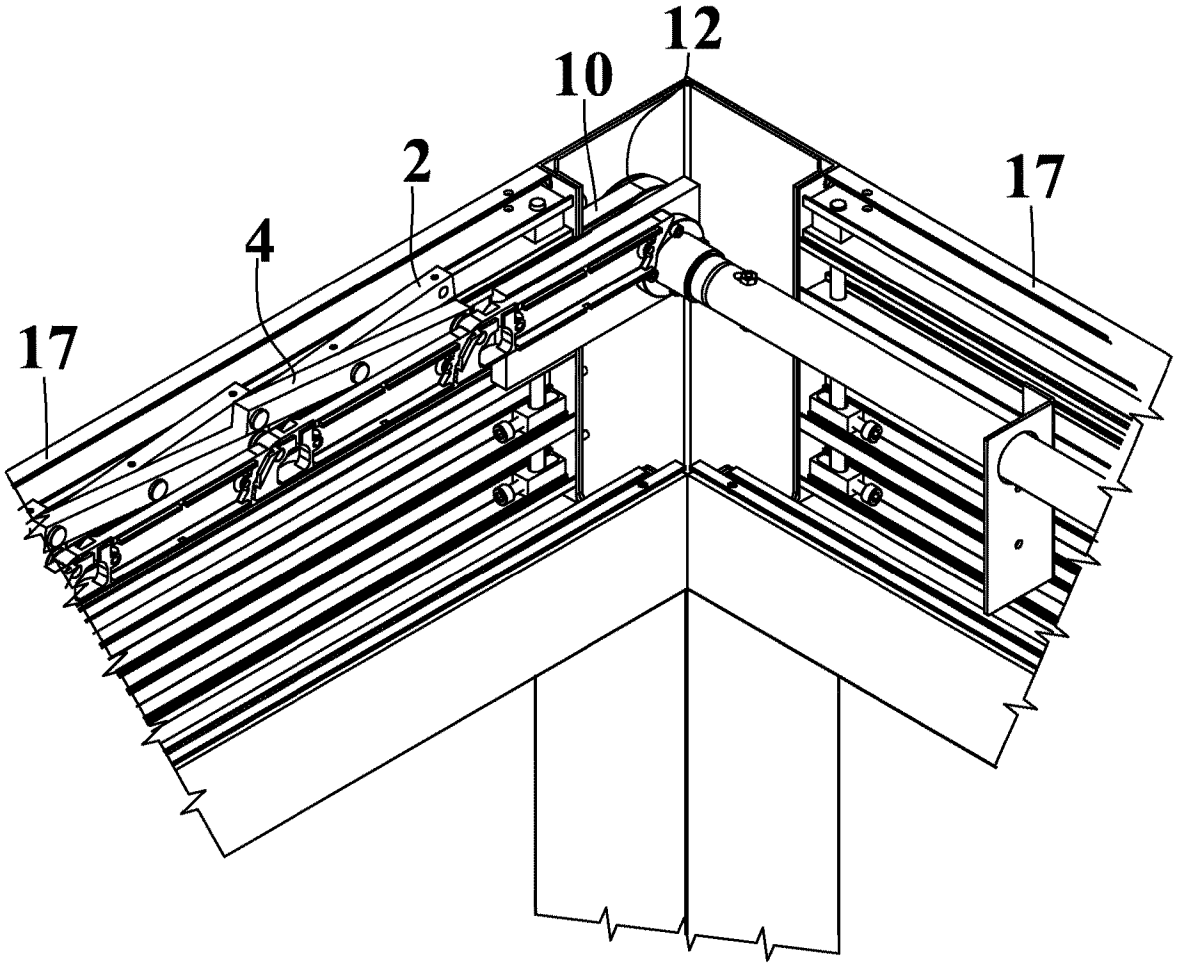
Figure 40:
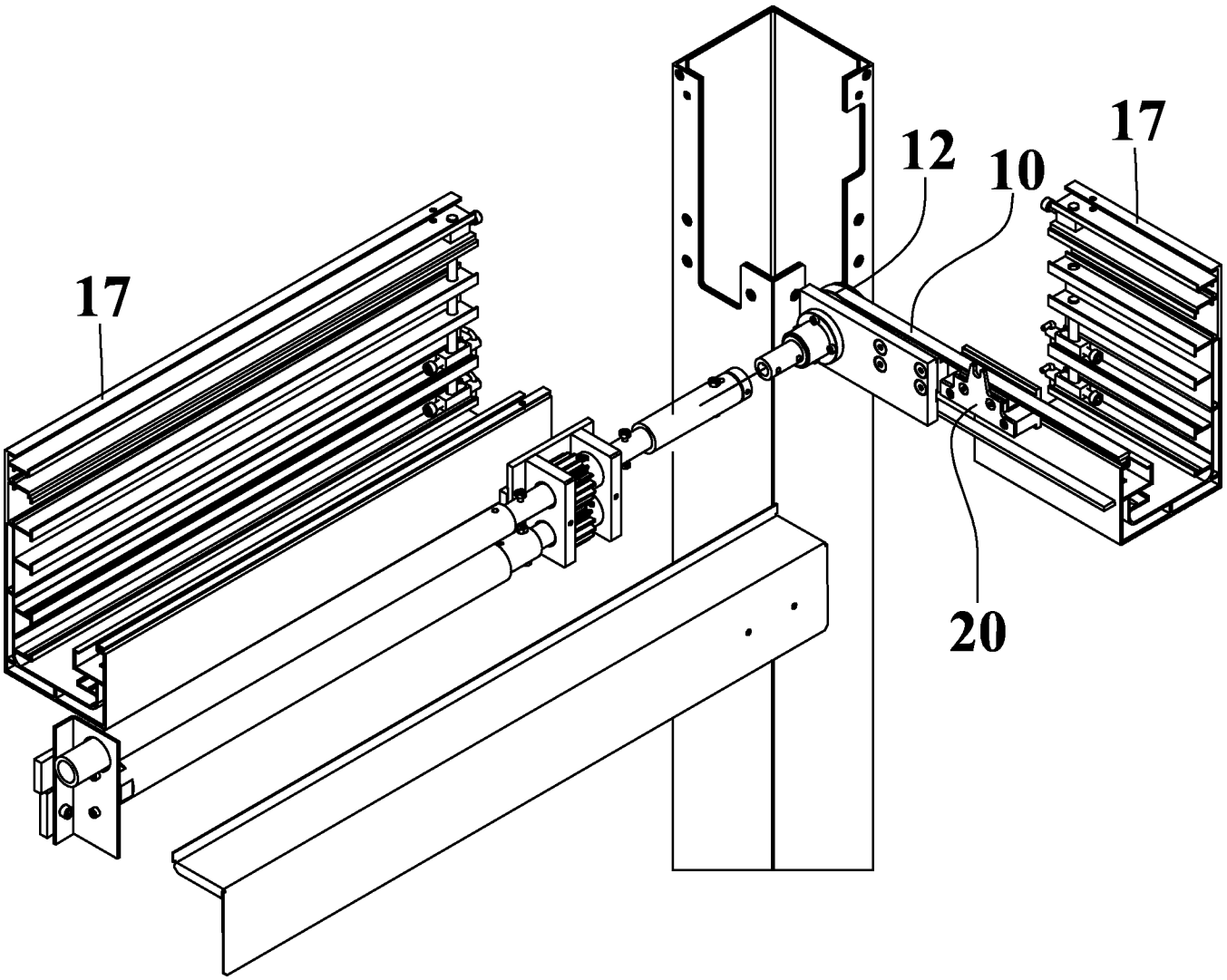
FIG. 40 illustrates an exploded view of FIG. 39.

One end of the pantograph of each distance adjustment member 21 is fixed to the device frame 48 at or near a transversal side of the frame itself and the opposite end of the pantograph element, connected to the slat element which carries out the greater excursion between the opened O and closed C conditions, is provided with a connection element 20, visible for example in FIGS. 15, 17 and 27, which connects this movable pantograph end to a flexible annular element 10, for example a belt or a annular chain, placed between two pulley elements of which a powered pulley element 12 as shown, for example, in FIGS. 27, 35 and 40.

The actuation of the left and right powered pulley elements 12, for example connected by a transmission shaft driven in axial rotation by a single motor, causes the lengthening and the shortening of pantographs of the distance adjustment member 21, causing the slat element translation between the opened and closed conditions and vice versa.

Alternatively, the invention provides that the pantograph movable end of each distance adjustment member 21 is operated between the closed and opened conditions, by a screw and nut actuator, by a rack and motorized pinion gear or by another type of known actuator.

A further alternative provides that each distance adjustment member 21 comprises, instead of the pantograph, a plurality of flexible tie rods interposed between said axles 9 to determine their mutual maximum distance and at least one flexible ring element placed between two pulleys of which one is motorized to translate the axle 9 of slat element 3 opposite to a slat element fixed between the opened and closed conditions or vice versa or the invention provides that each distance adjustment member 21 comprises an actuator of the telescopic type or the like.

The two arm elements 23, each fixed to a corresponding minor transversal right or left side of the respective slat elements 3 are mutually inclined towards the inside of the opening or downwards with respect to the covering and, as seen, each right or left transversal side of the slat elements is connected to a right or left distance adjustment member 21, to a right or left rotation members 27 and to the first site for sliding 15 of a right or left side guide element 17.

It is also provided and illustrated that the device comprises a single rotation member 27, right or left with a single translation actuator member 41 for the translation of the rotation member 27 and a single swivel actuator member 43 for the switch elements 35 set of the rotation member 27.

In the following, reference will be made to the case of two right and left translation actuator members 41 and two right and left swivel actuator members 43, but only for illustrative and non-restrictive purposes.

The opposite end to the slider element 25 of each arm element 23 has a protrusion which acts as an end element 47 of the respective slat element 3 occluding its terminal section of the corresponding transversal side (see especially FIG. 20).

These arm element 23 and end element 47 are almost straight and form an interposed angle of about 145° or between 60°-160° taking the form of a very open "V".

The axle 9, arranged in correspondence with the first longitudinal main side 6, is engaged in the joining point of the corresponding arm element 23 to the respective end element 47; in the case, already contemplated, of constructing each axle in two distinct segments, the union zone of the arm element 23 to the respective end element 47 of each right or left transversal side of a slat element, may have a fixing seat for respective right or left segment of the axle 9.

Said translation actuator members 41, for the translation of the right and left rotation members 27 along said second sites for sliding 29 of the respective side guide elements 17, include, for each rotation member 27, a first linear actuator, for example of the electric type, having one end fixed to the side guide element 17 or to a frame 48 which comprises said side guide element and the other end connected to the rotation member 27 or preferably to a section bar 49 or other elongated element, for example consisting of a "L" section bar in aluminium alloy or other metal, fixed to such rotation member 27.

Figure 23:
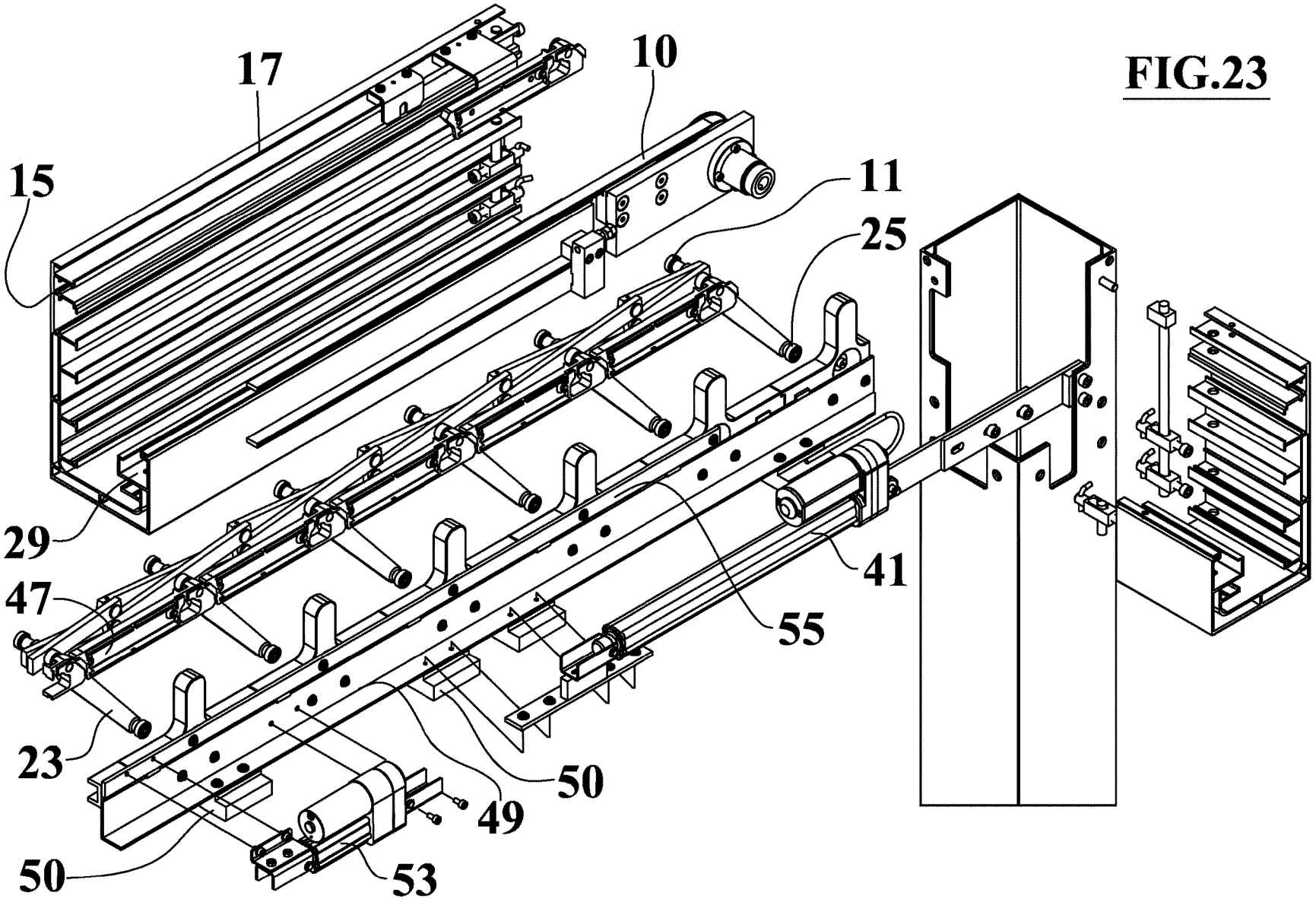
FIG. 23 illustrates an exploded view of FIG. 22.
Figure 24:
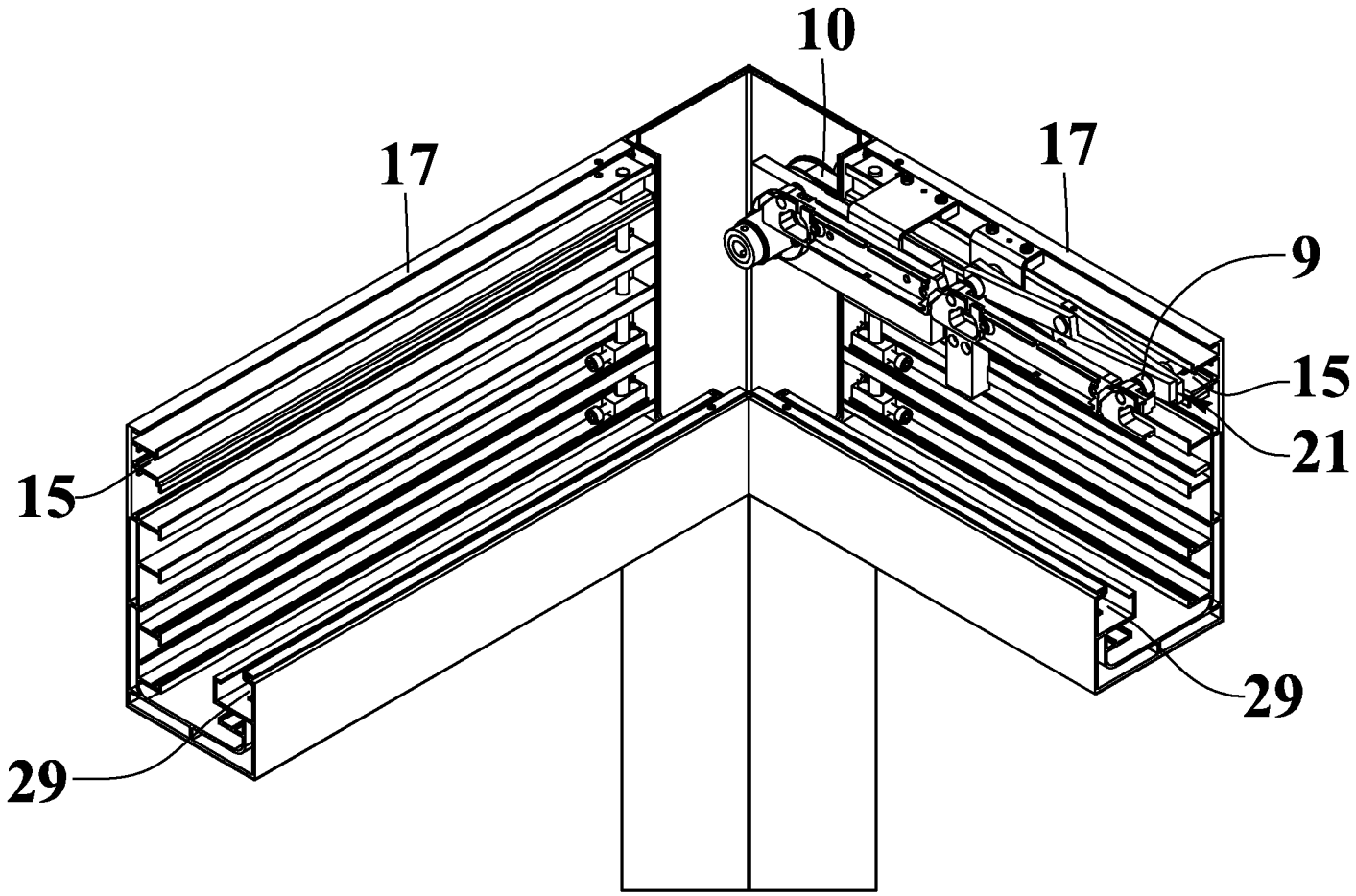
FIGS. 24, 25 and 26 show enlarged and axonometric views of other FIG. 21 details.
Figure 25:
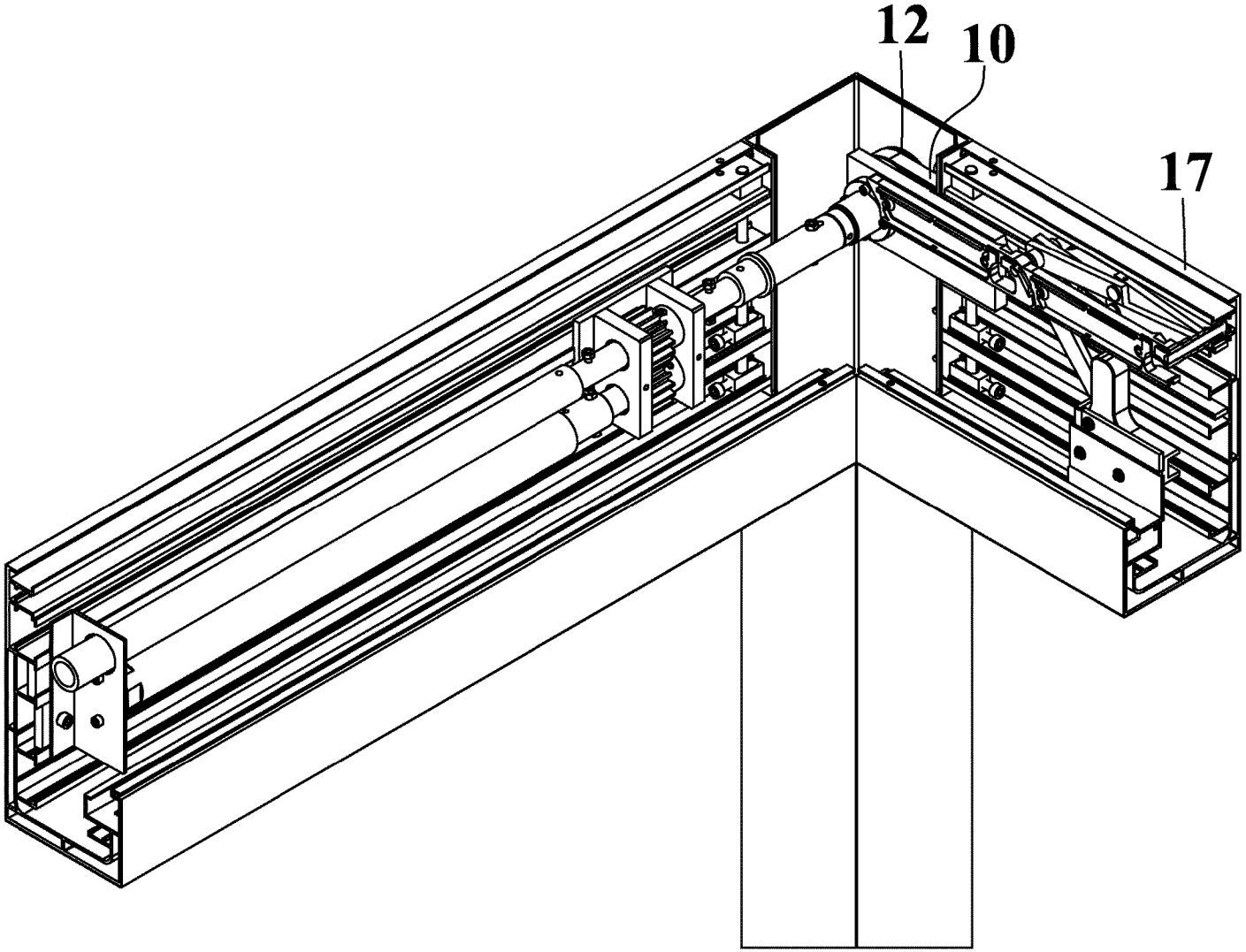
Figure 26:
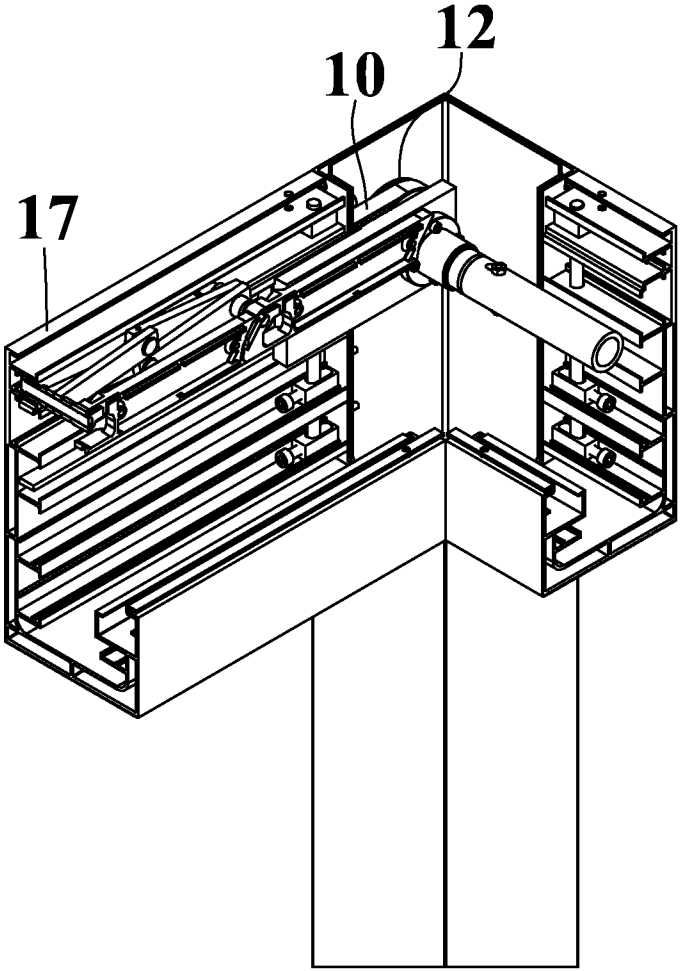

The section bar 49 carries a plurality of sliding block elements 50, illustrated in FIG. 23, of low-friction material and sliding in the respective longitudinal second sites for sliding 29 formed in the side guide element 17.

The first linear actuator line of action is parallel to the side guide element 17 to translate the rotation member 27 in or along the side guide element 17.

The switch elements 35 have an external shape approximately like a cylindrical wall or can be inscribed in a cylinder, as shown in FIG. 20, and are rotatably housed around their own axis in cylindrical seats formed in the rotation member 27 at the intersections of the longitudinal track element 31 with the transversal track elements 33.

The swivel actuator members 43 of each switch elements 35 right and/or left set comprise a second linear actuator 53, for example of the electric type and illustrated in FIGS. 22, 32, 34 and 36, having an end connected to the rotation member 27 or the section bar 49 or other elongated element fixed thereto 27 which slides along its second site for sliding 29 formed longitudinally in the side guide element 17.

The second linear actuator 53 other end is connected to a transmission rod 55 slidable on such rotation member 27 or on the corresponding section bar 49.

Said rod 55 is connected to eccentric elements 57, for example consisting of pins protruding from the faces of the switch elements 35 opposite to the swivelling track element 37 and engaged in respective holes made in the rod 55, to rotate such eccentric elements 57 following the actuation of the corresponding second linear actuator 53 and to obtain alignment of the swivelling track elements 37 to the longitudinal track element 31 or to the corresponding transversal track element 33.

The eccentric elements 57 are forced to travel along circumferential sector paths and for the correct kinematic coupling, the rod 55 holes are in the form of transversely elongated slots or the coupling between the rod and the second linear actuator 53 provides a play transversal to the rod or the second linear actuator 53 ends are connected by pins which allow the inclination of such second linear actuator 53.

Alternatively, the swivel actuator members 43 comprise a motorized rack in such a way to translate axially along the rotation member 27 or along the section bar 49 or other elongated element fixed to the rotation member 27; such motorized rack is engaged with toothed wheels formed or fixed peripherally to the switch elements 35 to rotate them and to obtain the alignment of the swivelling track elements 37 to the longitudinal track element 31 or to the corresponding transversal track element 33.

The invention optionally provides for each rotation member 27 to consist of a plurality of modules, each for a respective slat element 3.

These modules can be mutually connected in series, for example with jointing or preferably, as illustrated, by means of screw fixing or similar to the section bar 49 or other elongated element.

Each module comprises a transversal track element 33, a switch element 35 provided with a corresponding swivelling track element 37 and a section of the longitudinal track element 31 to allow such rotation member 27 to be made for almost any number of slat elements 3.

The modularity of each rotation member and pantograph, together with the possibility of cutting to size the slat elements and the device profiles, allowing one to carry out the invention in a simple and fast way, so as to provide a device with measures suitable for almost any opening or covering.

Glossary device (1)
slat element (3)
first longitudinal main side (6) and
second longitudinal main side (7)
axle (9)
flexible annular element (10)
end (11) of axle (9)
powered pulley element (12)
first site for sliding (15)
side guide element (17)
connection element (20)
distance adjustment member (21)
arm element (23)
slider element (25)
rotation member (27)
second site for sliding (29)
longitudinal track element (31)
transversal track element (33)
switch element (35)
swivelling track element (37)
translation actuator member (41)
swivel actuator member (43)
arms couple (2, 4)
end element (47)
frame (48)
section bar (49)
sliding block element (50)
first linear actuator (41)
second linear actuator (53)
rod (55)
eccentric element (57)
opened condition (O)
closed condition (C)

The invention claimed is:

1. Sunscreen device (1), comprising at least a plurality of elongated slat elements (3), movable between an opened condition (O) and a closed condition (C), each slat element having two transversal sides and two longitudinal main sides including a first longitudinal main side (6) and second longitudinal main side (7) and having an axle (9) parallel to the two longitudinal main sides (6, 7), wherein ends (11) of each axle (9) protrude from said transversal sides and longitudinally slide along respective first lateral sites for sliding (15) each of the sites for sliding along a longitudinal extension of a side guide element (17) perpendicular to the slat elements (3) and fixable to a structure; each axle (9) connected to at least one distance adjustment member (21) that regulates a distance between the axles between a minimum distance value in the opened condition (O) and a maximum distance value in the closed condition (C), where each slat element (3) carries at least one respective arm element (23) provided with a slider element (25) at a free end thereof; wherein the device further comprises at least a rotation member (27) for rotation, in the closed condition (C), of each slat element (3), around one of the axles (9), wherein the rotation member (27) comprises a longitudinal track element (31) parallel to said first lateral sites for sliding (15) and comprises, for each slat member (3), a corresponding transversal track element (33) where the transversal track elements (33) are inclined with respect to the longitudinal track element (31) and placed at mutual distances equal to the maximum distance value in the closed condition (C) between the axles, and said rotation member (27) also comprises a plurality of switch elements (35) each placed at an intersection between the longitudinal track element (31) and the transversal track element (33) for one of the slat elements for rotating between a rotating condition that aligns the corresponding switch element with the respective transversal track element (33) and a sliding condition that aligns the corresponding switch element with the longitudinal track element (31); said device further comprising a translation actuator member (41) connected to the rotation member (27) for translating the rotation member (27) parallel to the longitudinal track element (31) and a swivel actuator member (43) connected to the switch elements (35) to synchronously rotate swivelling track elements (37) between the rotating and sliding conditions; where each slider element (25) of each slat element (3) is assigned to slide in the respective transversal track elements (33) with each switch element (35) aligned therewith for rotation of the respective slat element (3) in the closed condition (C) and along the longitudinal track element (31) with said said each switch element (35) aligned therewith during the translation of the respective slat element (3) between the closed condition (C) and the opened condition (O) and vice versa; wherein in an operative and closed condition (C) the slider elements (25) of the slat elements (3) slide along the transversal track elements (33) and swivelling track elements (37) as a result of the translation of the rotation member (27) implemented by the translation actuator member (41) and modify an angle of the respective slat elements (3) by rotation around the respective axles (9); and wherein when the slat elements (3) form a predetermined value of the angle of rotation, the slider elements (25) are positioned such that actuation of the swivel actuator member (43) aligns the respective switch element (35) to the longitudinal track element (31) allowing the sliding of the slider elements (25) along the longitudinal track element (31) and allowing the at least one distance adjustment member (21) to translate the slat elements (3) towards the opened condition (O).

2. Device according to claim 1, wherein each distance adjustment member (21) comprises a plurality of flexible tie rods interposed between said axles (9) to determine a mutual maximum distance and at least one flexible annular element placed between two pulleys, wherein one pulley of the two pulleys is motorized to translate the axle (9) of the slat element (3) opposite to one of the slat elements fixed between the opened and closed conditions or vice versa or may comprise a telescopic actuator or each distance adjustment member (21) comprises a pantograph provided with arms (2, 4) mutually articulated for each slat element (3) where the respective axle (9) is rotatably connected to at least one arm of said arms (2, 4); wherein the pantograph is actuated to reach maximum and minimum pantograph lengths, corresponding to the closed and opened conditions, by a screw and nut screw actuator, by a motorized rack and pinion gear or by the at least one flexible annular element (10) placed between the two pulleys.

3. Device according to claim 2, wherein the axle (9) of each slat element (3) constitutes the mutual interconnection or end pin of said mutually articulated arms (2, 4).

4. Device according to claim 1, wherein one or both of the transversal sides of each slat element (3) have respective arm elements (23) having a respective slider element mounted at a slider end.

5. Device according to claim 4, wherein an end opposite to the slider element (25) of each arm element is provided with a protrusion that acts as an end element (47) of the respective slat (3) at which transversal side the end element (47) is fixed, wherein together the arm element (23) and the end element (47) form an interposed angle between 60° and 160°.

6. Device according to claim 1, wherein each axle (9) is arranged at a center line of one of the slat elements (3) or at one of the longitudinal main sides (6, 7).

7. Device according to claim 5, wherein the axle (9) is arranged at one of the longitudinal main sides (6, 7) of the slat element (3) and at a joining point of the corresponding arm element (23) to the respective end element (47).

8. Device according to claim 1, wherein the translation actuator member (41) includes a first linear actuator having an end fixed to the side guide element (17) or to a frame (48) comprising said side guide element (17) and an other end connected to the rotation member (27) or to a section bar or other elongated element (49) fixed thereto and sliding in a longitudinal second site for sliding (29) formed in the side guide element (17), wherein a straight line of actuation of the first linear actuator is parallel to the side guide element (17) for translating the rotation member (27) along the side guide element (17).

9. Device according to claim 1, wherein the switch elements (35) are approximately cylindrical in shape and are rotatably accommodated around axles thereof in cylindrical seats carried out in the rotation member (27) at the intersection of the respective longitudinal track element (31) and the respective transversal track element (33); wherein the swivel actuator member (43) comprises a motorized rack for axially translating along the rotation member (27) or a section bar or other elongated element (49) fixed thereto (27) where said motorized rack is meshed with toothed wheels obtained or fixed peripherally to the switch elements (35) to rotate them and to obtain alignment of the switch elements (35) with the longitudinal track elements (31) or to the corresponding transversal track elements (33) or the swivel actuator member (43) comprises a second linear actuator (53) having one end pivoted to the rotation member (27) or to a section bar or other elongated element (49) fixed to the rotation member (27) and sliding in a longitudinal seat made in the side guide elements (17) and another end pivoted to a rod (55) for sliding it along said rotation member (27) or section bar (49), said rod (55) connected to eccentric elements (57) of the switch elements (35) for rotating the switch elements (35) so as to align with the longitudinal track element (31) or to the corresponding transversal track element (33).

10. Device according to claim 1, wherein the rotation member (27) consists of a plurality of modules, each for a respective slat element of the plurality of elongated slat elements (3), the modules mutually connectable in series, where each module comprises the corresponding transversal track element (33), a corresponding switch element of said plurality of switch elements (35) and a portion of the longitudinal track element (31) and the rotation member (27) is provided for any number of corresponding elongated slat elements (3) of the plurality of elongated slat elements consisting of aluminum profiles or profiles of other material that are cut to size for any width of opening or covering.

* * * * *